US012588771B2

(12) United States Patent
Xu et al.

(10) Patent No.: US 12,588,771 B2
(45) Date of Patent: Mar. 31, 2026

(54) DISPLAY MOUNTING SUPPORT

(71) Applicant: Xinadda (Hong Kong) Limited, Hong Kong (CN)

(72) Inventors: Hao Xu, Hong Kong (CN); Xunyi Yang, Hong Kong (CN)

(73) Assignee: Xinadda (Hong Kong) Limited, Hong Kong (CN)

( * ) Notice: Subject to any disclaimer, the term of this patent is extended or adjusted under 35 U.S.C. 154(b) by 111 days.

(21) Appl. No.: 18/825,515

(22) Filed: Sep. 5, 2024

(65) Prior Publication Data

US 2026/0041259 A1 Feb. 12, 2026

(30) Foreign Application Priority Data

Aug. 9, 2024 (CN) ..... 202421934029.2

(51) Int. Cl.
*F16M 13/02* (2006.01)
*A47F 5/08* (2006.01)

(52) U.S. Cl.
CPC ..... *A47F 5/0815* (2013.01); *A47F 5/0838* (2013.01); *A47F 5/0853* (2013.01)

(58) Field of Classification Search
CPC ..... A47F 5/0815; A47F 5/0838; A47F 5/0853
USPC ..... 248/919
See application file for complete search history.

(56) References Cited

U.S. PATENT DOCUMENTS

| | | | | |
|---|---|---|---|---|
| 11,105,458 | B2 * | 8/2021 | Runger | F16M 11/041 |
| 12,163,621 | B2 * | 12/2024 | Xu | F16M 13/02 |
| 2005/0274855 | A1 * | 12/2005 | Shin | F16M 11/048 248/220.22 |
| 2011/0174939 | A1 * | 7/2011 | Taylor | F16M 11/10 24/565 |

* cited by examiner

*Primary Examiner* — Amy J. Sterling
(74) *Attorney, Agent, or Firm* — IP Spring

(57) ABSTRACT

The present disclosure provides a display mounting support, including a wall plate and a hanging support. The hanging support includes a hook member, an elastic snapping assembly, a connecting rod, and a hanging member. The hook member is mounted to the wall plate. The hook member includes a hook portion. The hanging member includes a connecting portion and a snapping protrusion. The connecting portion is connected to one end of the connecting rod. When the connecting rod is hung into the hook portion, and the snapping protrusion is snapped with the elastic snapping assembly, the display mounting support is in a locked state. When the snapping protrusion is separated from the elastic snapping assembly, or the connecting rod is separated from the hook portion, the display mounting support is in an unlocked state. The present disclosure facilitates the snapping protrusion to separate from the elastic snapping assembly when necessary.

20 Claims, 20 Drawing Sheets

DISPLAY MOUNTING SUPPORT

CROSS-REFERENCE TO RELATED APPLICATIONS

This application claims priority under 35 U.S.C. § 119(a) to and the benefit of Chinese Application patent application Ser. No. 20/242,1934029.2, filed on Aug. 9, 2024, the entire disclosure of which is hereby incorporated by reference.

TECHNICAL FIELD

The present disclosure relates to technical fields of display mounting, and in particular relates to a display mounting support.

BACKGROUND

Ultra-thin display screen is already a design trend of a current display screen. Accordingly, ultra-thin display mounting support is needed, which can decrease a distance from a wall of the display screen after the display screen is mounted on the wall. The current ultra-thin display mounting support uses a magnetic auxiliary connection when suspending the display screen. However, the magnetic auxiliary connection does not play a role of auxiliary connection when the magnetic force is too small, the magnetic auxiliary connection will lead to increased difficulty in separating the display screen from a wall plate of the current ultra-thin display mounting support when the magnetic force is too large, which easily cases the display screen to be damaged.

SUMMARY

In view of this, the present disclosure proposes a display mounting support, to solve the above technical problems.

In a first aspect, the present disclosure provides a display mounting support. The display mounting support includes a wall plate configured to be fixed to a load-bearing body and a hanging support. The hanging support includes a hook member, an elastic snapping assembly, a connecting rod and a hanging member. The hook member is mounted on the wall plate and includes a hook portion. A partial structure of the elastic snapping assembly is stationary relative to the hook member, another structure of the elastic snapping assembly is capable of stretching out and drawing back along a height direction of the display mounting support. The hanging member is configured to be connected with a display screen and includes a connecting portion and a snapping protrusion. The connecting portion is connected to one end of the connecting rod, the other end of the connecting rod is capable of being hung into the hook portion of the hook member. The snapping protrusion is capable of being snapped with the clastic snapping assembly. When the other end of the connecting rod is hung into the hook portion of the hook member, and the snapping protrusion is snapped with the elastic snapping assembly, the display mounting support is in a locked state. When the snapping protrusion is separated from the clastic snapping assembly, or the other end of the connecting rod is separated from the hook portion of the hook member, the display mounting support is in an unlocked state.

Therefore, in the present disclosure, firstly, the display screen is mounted on a front surface of the hanging member; secondly, the connecting rod which is connected to a back surface of the hanging member is hung into the hook portion of the hook member; thirdly, the display screen is pushed to move towards the load-bearing body, such that the snapping protrusion of the hanging member is locked with the elastic snapping assembly, the display mounting support is in the locked state. Conversely, when the display screen is pulled to move towards a side away from the load-bearing body, the snapping protrusion is separated from the clastic snapping assembly, the display mounting support is in the unlocked state. Therefore, the present disclosure suspends the display screen by means of one hanging and one snap, which facilitates the snapping protrusion to separate from the elastic snapping assembly when necessary, and can greatly reduce the distance of the display screen from the load-bearing body.

BRIEF DESCRIPTION OF THE ACCOMPANYING DRAWINGS

To describe the technology solutions in the embodiments of the present disclosure more clearly, the following briefly introduces the accompanying drawings required for describing the embodiments. Obviously, the accompanying drawings in the following description show merely at least one embodiment of the present disclosure, those of ordinary skilled in the art may also obtain other drawings based on these drawings without any creative efforts.

Figure 1:
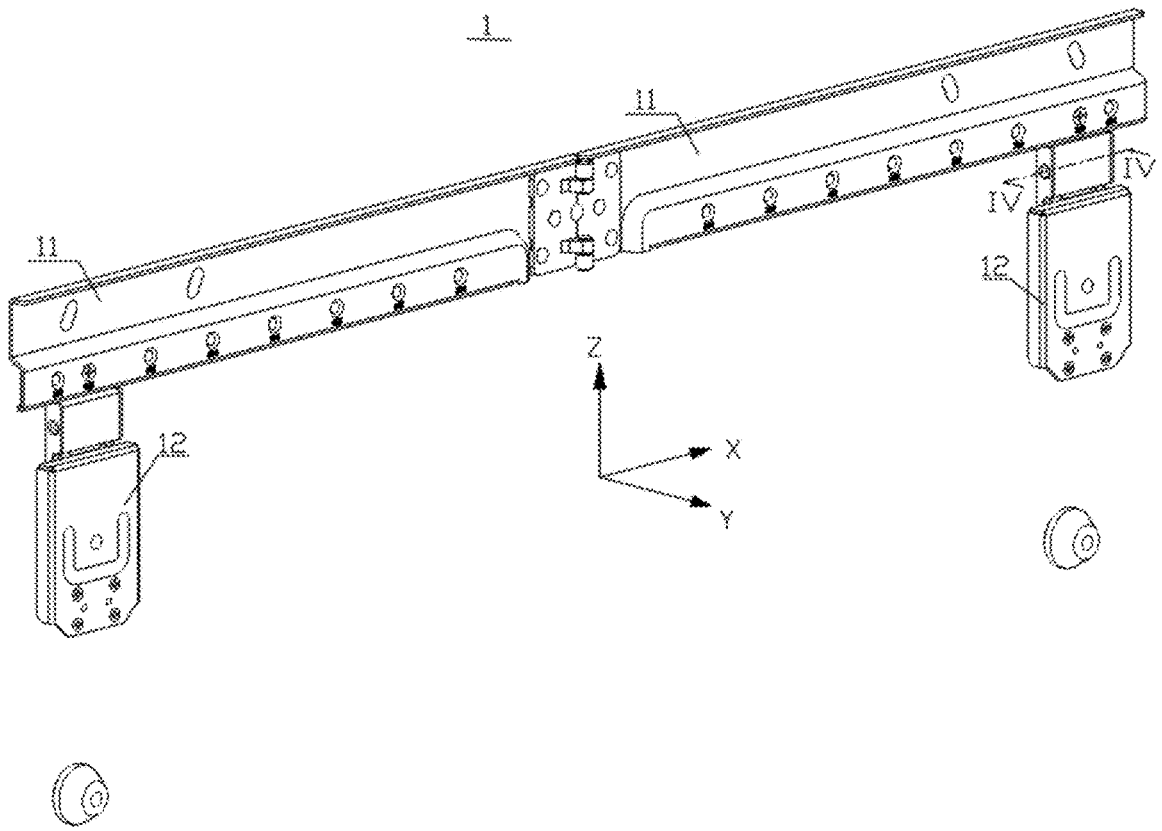
FIG. 1 illustrates a schematic view of a three-dimensional structure of a display mounting support in accordance with one embodiment of the present disclosure when the display mounting support is in a locked state.

THE DESCRIPTION OF REFERENCE SIGNS display mounting support—1;

Wall plate—11; plate portion—111; strip mounting hole—1111; protrusion—1115; second connecting portion—112; connect hole—1121; folding edge—112*a*; first wall plate—113; second wall plate—114; hinged piece—115; resisting surface—116; connecting member—117; s-shaped portion—1171; first bending portion—1172; second bending portion—1173; center hole—118;

Hanging support—12;

Hook member—121; hook portion—1211; first back plate segment—1212*a*; adjustment segment sidewall—1212*b*; adjust hole—1212*c*; second back plate segment—1212*d*; hook—1212*e*; avoidance segment sidewall—1212*f*; first connecting portion—1213; third back plate segment—1213*a*; connecting segment sidewall—1213*b*; bayonet—1213*c*; nut column—1214;

Elastic snapping assembly—122; grab—1221; plane—1221*a*; first incline surface—1221*b*; second inclined surface—1221*c*; fixed member 1222; supporting portion—1222*a*; cross-connecting portion—1222*b*; resisting portion—1222*c*; through hole—1222*d*; sliding block—1223; sliding body—1223*a*; receiving hole—1223*b*; elastic member—1224;

Connecting rod—123; inserting end—1231;

Hanging member—124; connecting portion—1241; first resisting member—1241*a*; second resisting member—1241*b*; hole—1241*c*; first arc-shaped portion—1241*d*; second arc-shaped portion—1241*e*; snapping protrusion—1242;

Adjusting member—125;

Snapping piece—126; fixed portion—1261; snapping portion—1262;

Display screen—2; load-bearing body—3.

DETAILED DESCRIPTION OF ILLUSTRATED EMBODIMENTS

Embodiments of the present disclosure are described in detail below. Examples of the embodiments are shown in the accompanying drawings. The same or similar labeling throughout denotes the same or similar elements or elements having the same or similar functions. The embodiments described below by reference to the accompanying drawings are exemplary and are intended to be configured to explain the present disclosure and are not to be construed as limiting the present disclosure.

Furthermore, the terms "first" and "second" are used for descriptive purposes only and are not to be understood as indicating or implying relative importance or implicitly specifying the number of technical features indicated. Therefore, a feature defined with "first" or "second" may include one or more such features, either explicitly or implicitly. In the description of the present disclosure, "more than one" means two or more, unless otherwise expressly and specifically limited.

In the present disclosure, unless otherwise expressly specified and limited, the terms "connected", "fixed", and so on are to be understood broadly, e.g., they may be fixedly connected, removablely connected, or integrally connected; they may be mechanically connected or electrically connected; they may be directly connected or indirectly connected through an intermediate medium; they may be interconnected within two elements or an interactive relationship between two elements. For those of ordinary skill in the art, the specific meaning of the above terms in the present disclosure may be understood on a case-by-case basis.

Referring to FIG. 1, FIG. 1 illustrates a schematic view of a three-dimensional structure of a display mounting support 1 in accordance with one embodiment of the present disclosure when the display mounting support 1 is in a locked state.

For convenience of description, a front-back direction of the display mounting support 1 shown in FIG. 1 is defined as a Y-axis direction, a left-right direction of the display mounting support 1 shown in FIG. 1 is defined as an X-axis direction, and a height direction of the display mounting support 1 shown in FIG. 1 is defined as a Z-axis direction. The orientation terms such as "top", "bottom", "left", "right", "front", and "back" mentioned in the description of the display mounting support 1 in the embodiments of the present disclosure are based on the orientation shown in FIG. 1 of the accompanying drawings of the specification, with a positive direction of Z-axis as the "top", a negative direction of Z-axis as the "bottom", a negative direction of X-axis as the "left" and a positive direction of the X-axis as "right", a positive direction of Y-axis as the "front" and a negative direction of the Y-axis as "back", which does not constitute a limitation of the display mounting support 1 in an actual application scenario.

Figure 2:
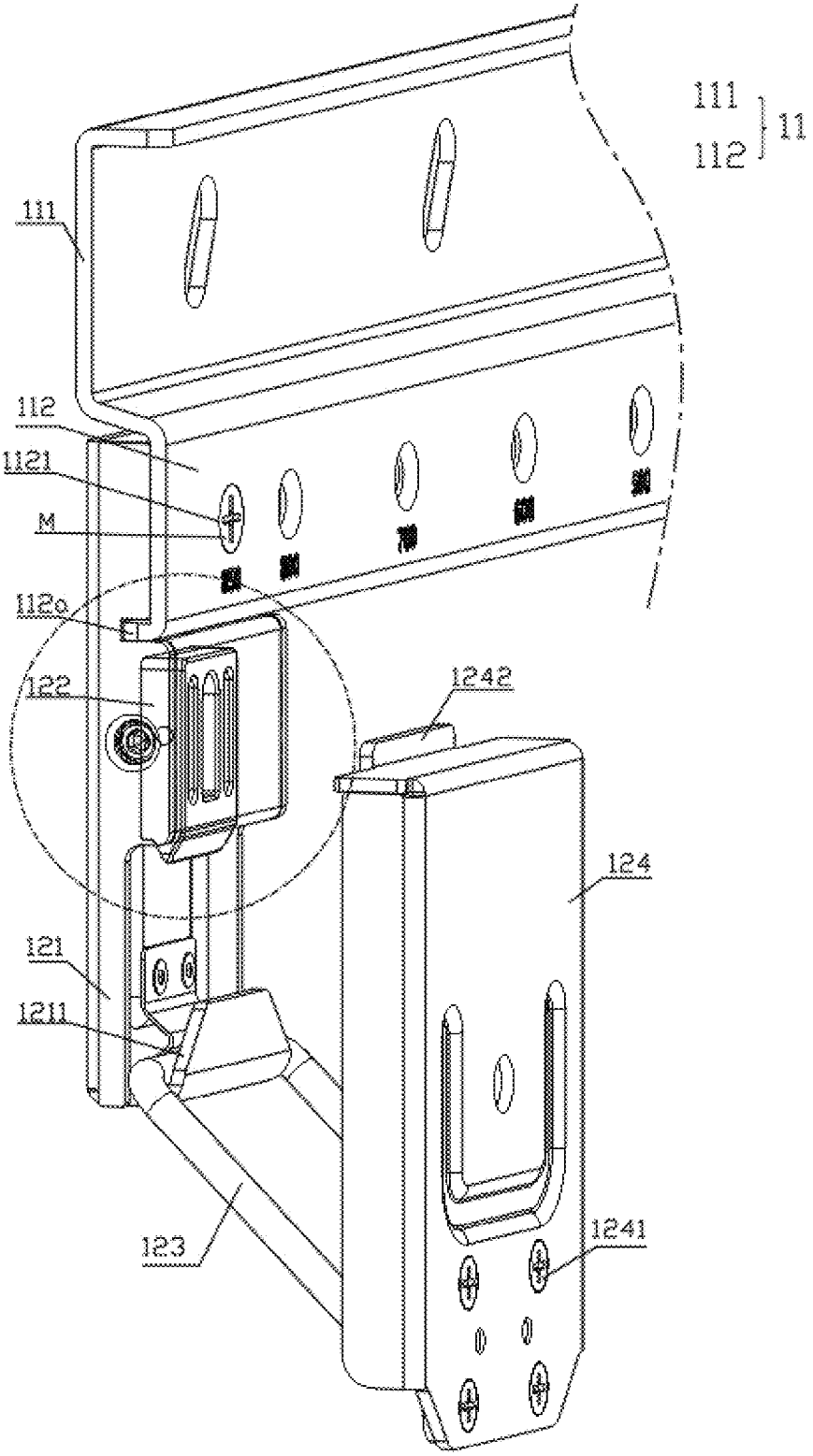
FIG. 2 illustrates a schematic view of a three-dimensional structure of a partial structural member of the display mounting support in accordance with one embodiment of the present disclosure when the display mounting support is in an unlocked state.

As shown in FIGS. 1 and 2, FIG. 2 illustrates a schematic view of a three-dimensional structure of a partial structural member of the display mounting support 1 in accordance with one embodiment of the present disclosure when the display mounting support 1 is in an unlocked state.

In detail, the display mounting support 1 includes a wall plate 11 being configured to be fixed to a load-bearing body, and a hanging support 12. The hanging support 12 includes a hook member 121, an elastic snapping assembly 122, a connecting rod 123, and a hanging member 124. The hook member 121 is mounted on the wall plate 11, and the hook member 121 includes a hook portion 1211. A partial structure of the elastic snapping assembly 122 is stationary relative to the hook member 121, another structure of the elastic snapping assembly 122 is capable of stretching out and drawing back along a height direction of the display mounting support 1. The hanging member 124 is configured to be connected with a display screen. The hanging member 124 includes a connecting portion 1241 and a snapping protrusion 1242. The connecting portion 1241 is connected to one end of the connecting rod 123, the other end of the connecting rod 123 is hung into the hook portion 1211 of the hook member 121. The snapping protrusion 1242 is snapped with the elastic snapping assembly 122. When the other end of the connecting rod 123 is hung into the hook portion 1211 of the hook member 121, and the snapping protrusion 1242 is snapped with the elastic snapping assembly 122, the display mounting support 1 is in a locked state. When the snapping protrusion 1242 is separated from the elastic snapping assembly 122, and/or the other end of the connecting rod 123 is separated from the hook portion 1211 of the hook member 121, the display mounting support 1 is in an unlocked state.

Therefore, in the present disclosure, firstly, the display screen is mounted on a front surface of the hanging member 124, secondly, the connecting rod 123 which is connected to a back surface of the hanging member 124 is hung into the hook portion 1211 of the hook member 121, thirdly, the display screen is pushed to move towards the load-bearing body, such that the snapping protrusion 1242 of the hanging member 124 is locked with the clastic snapping assembly 122, the display mounting support 1 is in the locked state. Conversely, when the display screen is pulled to move towards a side away from the load-bearing body, the snapping protrusion 1242 is separated from the elastic snapping assembly 1, the display mounting support 1 is in the unlocked state. Therefore, the present disclosure suspends the display screen by means of one hanging and one snap, which facilitates the snapping protrusion 1242 to separate from the elastic snapping assembly 122 when necessary, and can greatly reduce the distance of the display screen from the load-bearing body.

In some embodiments, the load-bearing body is a wall or a cabinet, etc., without limitation herein.

Figure 3:
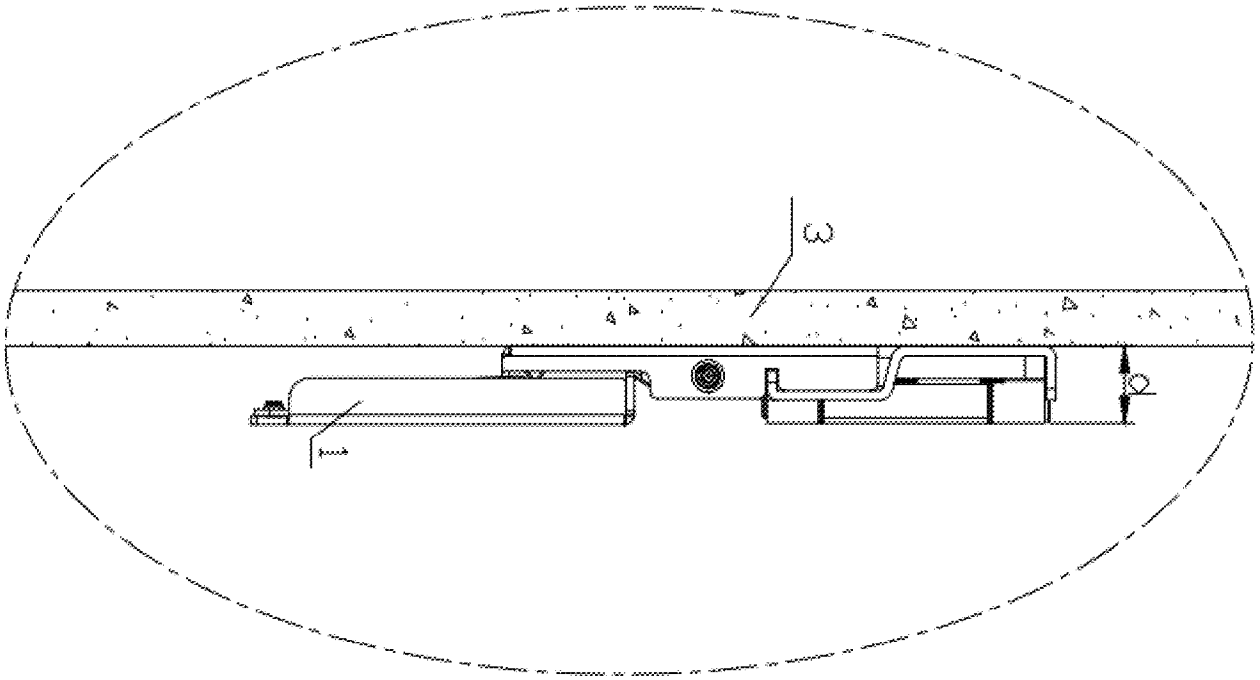
FIG. 3 illustrates a schematic view of a distance from a load-bearing body of the display mounting support in accordance with one embodiment of the present disclosure.

Referring to FIG. 3, FIG. 3 illustrates a schematic view of a distance from a load-bearing body 3 of the display mounting support 1 in accordance with one embodiment of the present disclosure. The distance from the load-bearing body 3 is a maximum distance between a surface of the display mounting support 1 back from the load-bearing body 3 and a surface of the load-bearing body 3 when the display mounting support 1 is in the locked state, that is a maximum thickness of the display mounting support 1 mounted on the load-bearing body 3 when the display mounting support 1 is in the locked state. As shown in FIG. 3, the display mounting support 1 is in the locked state, the distance d from the load-bearing body 3 of the display mounting support 1 is 20 mm. In other embodiment, the distance d from the load-bearing body 3 of the display mounting support I can be adjusted according to the need, without limited herein.

Therefore, an ultra-thin design of the display mounting support I can be achieved.

Figure 4:
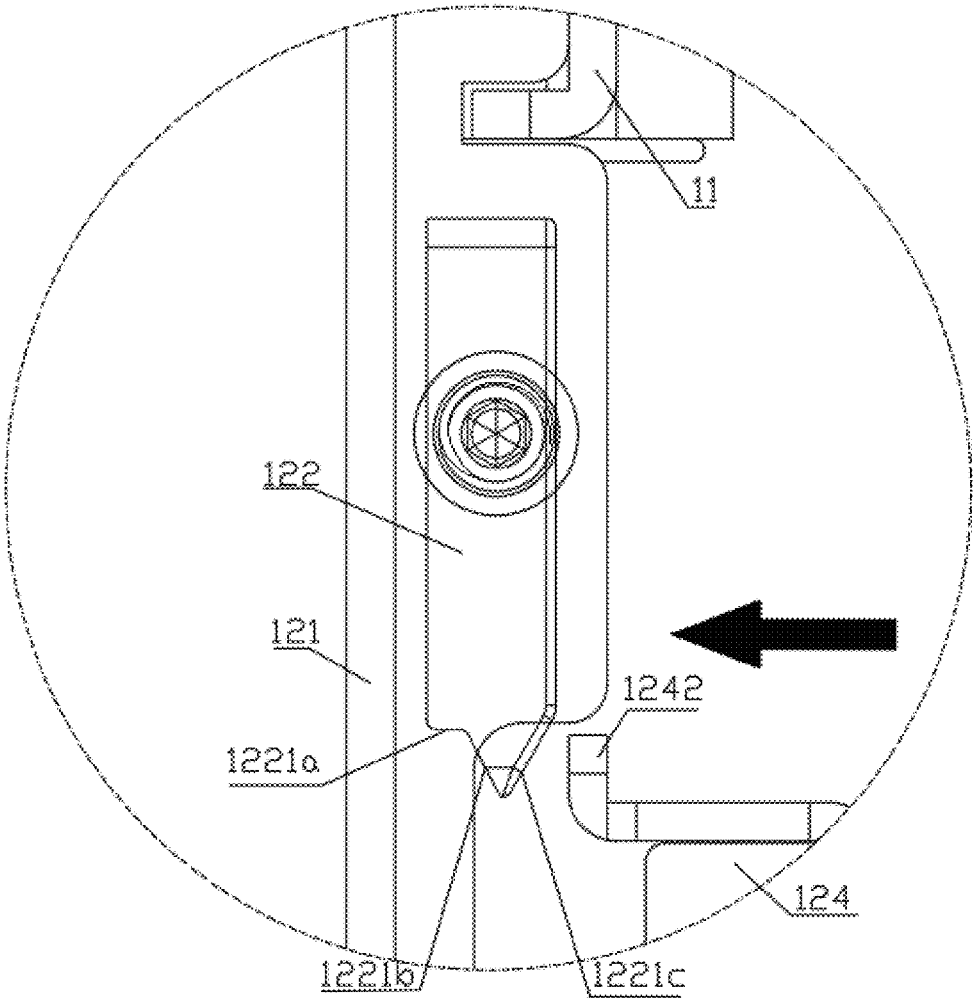
FIG. 4 illustrates a schematic view of the display mounting support in accordance with one embodiment of the present disclosure when the snapping protrusion is pushed towards the elastic snapping assembly.
Figure 5:
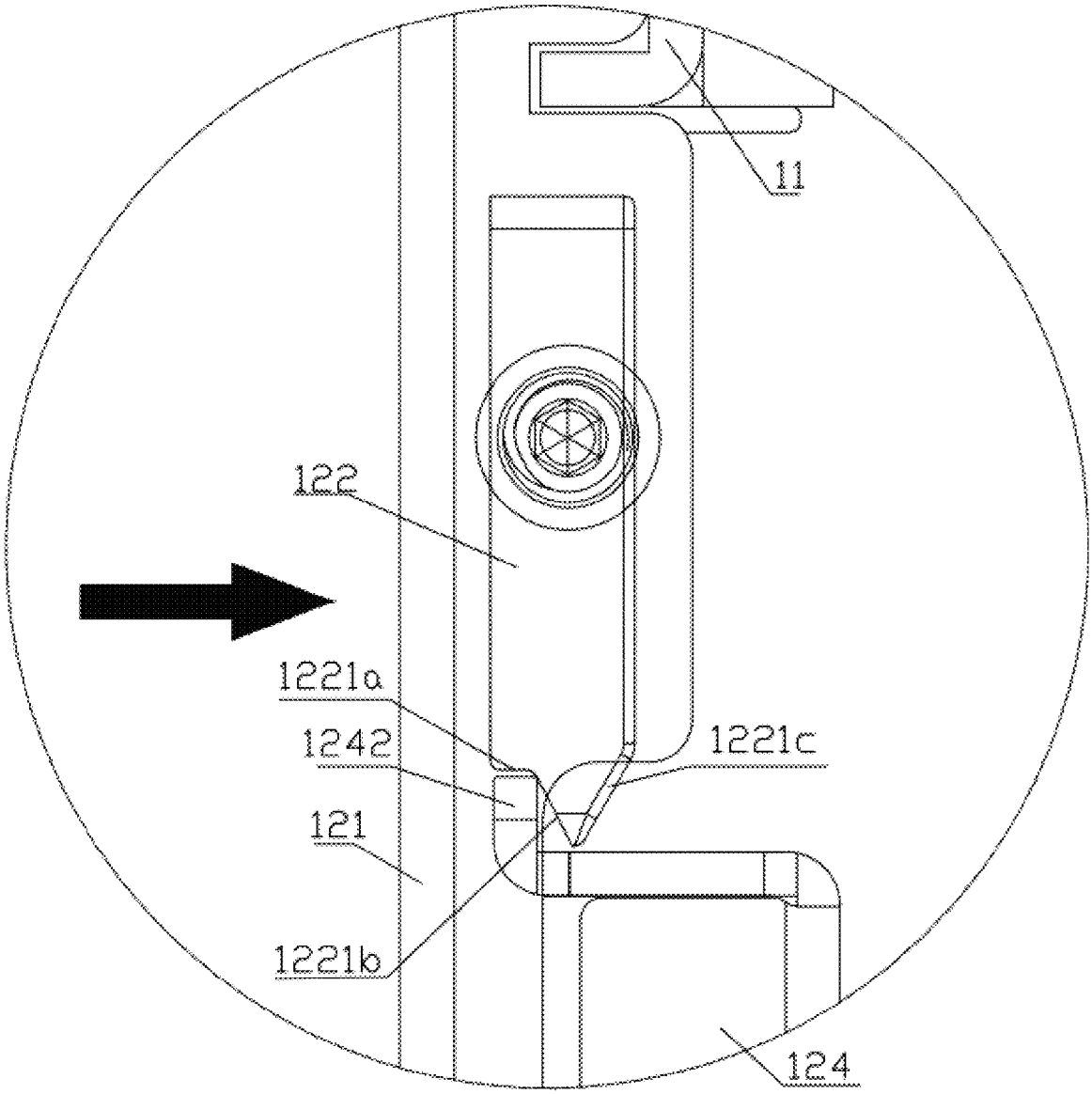
FIG. 5 illustrates a schematic view of the display mounting support in accordance with one embodiment of the present disclosure when the snapping protrusion is snapped with the clastic snapping assembly.

In detail, referring to FIGS. 4 and 5, when the display screen is pushed to move towards the load-bearing body 3, the snapping protrusion 1242 of the hanging member 124 is firstly resisted a surface of the clastic snapping assembly 122 back from the load-bearing body 3, and thus pushes the elastic snapping assembly 122 to draw back along the height direction of the display mounting support 1, and then the snapping protrusion 1242 of the hanging member 124 is pushed to move towards the load-bearing body 3 continuously, such that the snapping protrusion 1242 of the hanging member 124 is located on a side of the clastic snapping assembly 122 close to the load-bearing body 3 and not resisted the elastic snapping assembly 122, the elastic snapping assembly 122 is then stretching out along the height direction of the display mounting support 1, and is locked with the snapping protrusion 1242 of the hanging member 124, the display mounting support 1 is in the locked state as shown in FIG. 5.

Conversely, when the display screen is pulled to move towards a side away from the load-bearing body 3, the snapping protrusion 1242 of the hanging member 124 is firstly resisted a surface of the clastic snapping assembly 122 close to the load-bearing body 3, and thus pushes the clastic snapping assembly 122 to draw back along the height direction of the display mounting support 1 again, such that the snapping protrusion 1242 of the hanging member 124 is not resisted the elastic snapping assembly 122, the snapping protrusion 1242 of the hanging member 124 is separated from the elastic snapping assembly 122, the display mounting support 1 is in the unlocked state as shown in FIG. 4, the clastic snapping assembly 122 is stretching out along the height direction of the display mounting support 1 again.

In some embodiments, referring to FIGS. 4 and 5, the elastic snapping assembly 122 includes a grab 1221 formed at one end. The grab 1221 includes a plane 1221*a*, a first inclined surface 1221*b*, and a second inclined surface 1221*c*. The first inclined surface 1221*b* is connected between the plane 1221*a* and the second inclined surface 1221*c*. The plane 1221*a* is located close to the load-bearing body 3, and is substantially perpendicular to a surface of the load-bearing body 3. The first inclined surface 1221*b* faces the load-bearing body 3, and the second inclined surface 1221*c* backs the load-bearing body 3. The first inclined surface 1221*b* and the second inclined surface 1221*c* cooperatively form a V-shaped structure. When the snapping protrusion 1242 is snapped with the clastic snapping assembly 122, the snapping protrusion 1242 locates at a position corresponding to a position of the plane 1221*a*. During a process of the snapping protrusion 1242 to snap with the clastic snapping assembly 122, the snapping protrusion 1242 is resisted the second inclined surface 1221*c*. During a process of the snapping protrusion 1242 to separate from the elastic snapping assembly 122, the snapping protrusion 1242 is resisted the first inclined surface 1221*b*.

Therefore, when suspending the display screen, the display screen is pushed to move towards the load-bearing body 3, the snapping protrusion 1242 of the hanging member 124 is firstly resisted the second inclined surface 1221*c* of the clastic snapping assembly 122, as the second inclined surface 1221*c* is a wedge face, so the snapping protrusion 1242 can push the clastic snapping assembly 122 to draw back along the height direction of the display mounting support 1, the snapping protrusion 1242 of the hanging member 124 continues to move towards the load-bearing body 3, such that the snapping protrusion 1242 of the hanging member 124 is located on one side of the elastic snapping assembly 122 close to the load-bearing body 3 and not resisted the clastic snapping assembly 122, the snapping protrusion 1242 locates below the plane 1221*a*, and then the clastic snapping assembly 122 is stretching out along the height direction of the display mounting support 1, and is locked with the snapping protrusion 1242 of the hanging member 124, the display mounting support 1 is now in the locked state. Conversely, when the display screen is pulled to move away from the load-bearing body 3, the snapping protrusion 1242 of the hanging member 124 is firstly resisted the first inclined surface 1221*b* of the clastic snapping assembly 122, as the first inclined surface 1221*b* is also a wedge face, so the snapping protrusion 1242 can push the clastic snapping assembly 122 to draw back again along the height direction of the display mounting support 1, when the snapping protrusion 1242 of the hanging member 124 separates from the clastic snapping assembly 122, the display mounting support 1 is now in the unlocked state.

Therefore, in the present disclosure, as the end of the elastic snapping assembly 122 forms a V-shaped structure, when the elastic snapping assembly 122 is snapped with the snapping protrusion 1242, the display screen can be pulled by applying an external force to move away from the load-bearing body 3 such that snapping protrusion 1242 is separated from the clastic snapping assembly 122, but the snapping protrusion 1242 is kept to lock with the clastic snapping assembly 122 when no external force towards a side away from the load-bearing body 3 is applied to the display screen.

Figure 6:
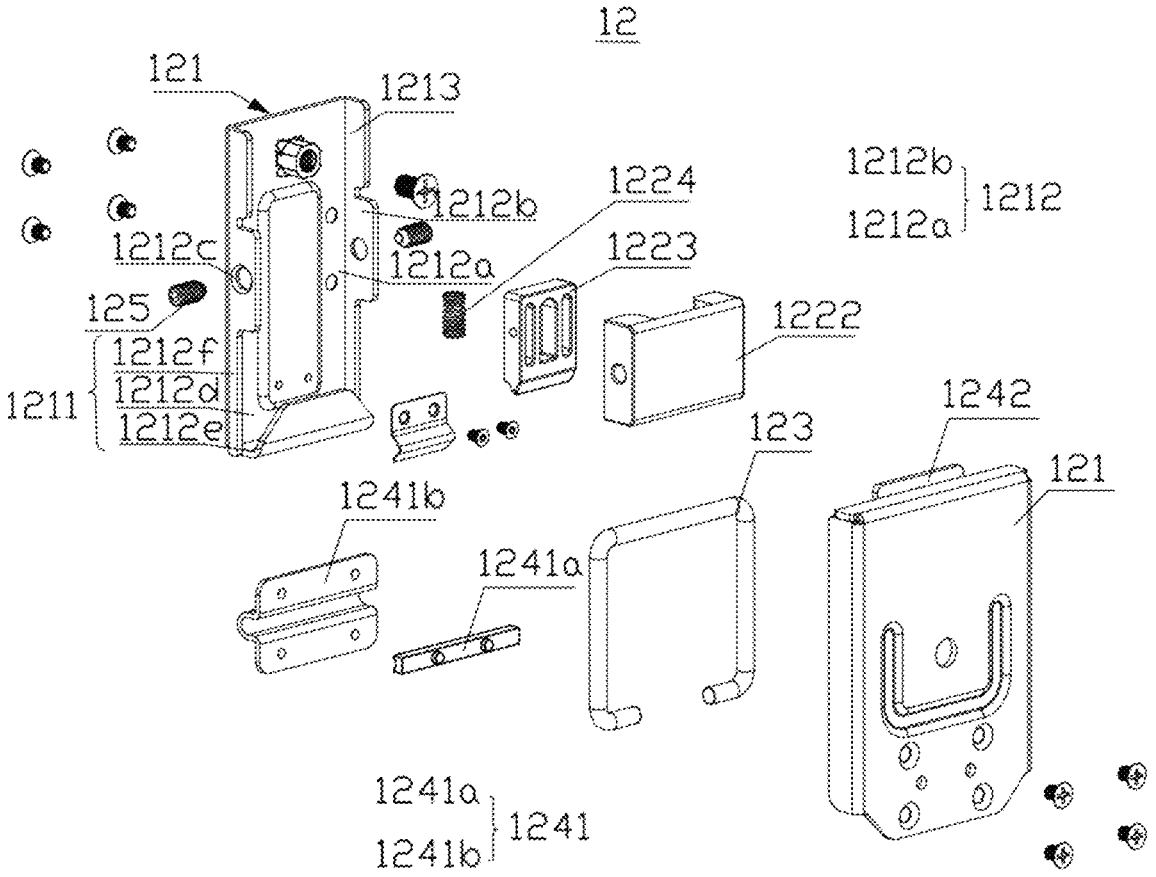
FIG. 6 illustrates an exploded view of a hanging support of FIG. 1.

In some embodiments, referring to FIGS. 2 and 6, FIG. 6 illustrates an exploded view of a hanging support of FIG. 1. The hook member 121 includes a mounting portion 1212. The mounting portion 1212 is located above the hook portion 1211, and connected to the hook portion 1211. A partial structure of the elastic snapping assembly 122 is fixed to the mounting portion 1212 and is stationary relative to the hook member 121, another structure of the clastic snapping assembly 122 is capable of stretching out and drawing back relative to the mounting portion 1212 along the height direction of the display mounting support 1. The snapping protrusion 1242 is located above the connecting portion 1241. The snapping protrusion 1242 locates at a position corresponding to a position of the elastic snapping assembly 122. The connecting portion 1241 locates corresponding to a position of the hook portion 1211.

Therefore, the snapping protrusion 1242 and the connecting portion 1241 are located at two spaced apart upper and lower positions, respectively, of a side of the hanging member 124 facing the load-bearing body 3. The clastic snapping assembly 122 and the hook portion 1211 are located at two spaced apart upper and lower positions of the hook member 121 along the height direction of the display mounting support 1, therefore, the snapping protrusion 1232 and the elastic snapping assembly 122 are closer to a top position of the wall plate 11 in the height direction of the display mounting support 1, the connecting portion 1241 and the hook portion 1211 are further away from the top position of the wall plate 11 in the height direction of the display mounting support 1, such that the connecting rod 123 which is connected with the connecting portion 1241 is firstly hung into the hook portion 1211 in a lower position, and then the snapping protrusion 1242 is snapped with the clastic snapping assembly 122 in a higher position, the overall structure of the display mounting support 1 is more compact.

In other embodiments, the connecting portion 1241 may be located at a more top position of the back surface of the hanging member 124, the snapping protrusion 1242 may be located at a more bottom position of the back surface of the hanging member 124. The back surface refers to a surface of the hanging member 124 that is not equipped with the display screen, that is a face facing the load-bearing body 3. The elastic snapping assembly 122 may be mounted on the load-bearing body 3 alone and located corresponding to a position of the snapping protrusion 1242, or, the wall plate 11 may be widened downwards such that the clastic snapping assembly 122 may be still mounted on the wall plate 11, therefore, the snapping protrusion 1242 and the clastic snapping assembly 122 are further away from the top position of the wall plate 11 in the height direction of the display mounting support 1, the connecting portion 1241 and the hook portion 1211 are more closer to the top position of the wall plate 11 in the height direction of the display mounting support 1, such that the connecting rod 123 which is connected with the connecting portion 1241 is hung into the hook portion 1211 at a higher position, and then the snapping protrusion 1242 is snapped with the clastic snapping assembly 122 at a lower position, although this will increase a size of the wall plate 11 of the display mounting support 1, this structure is also included in the protection scope of the present disclosure.

Figure 7:
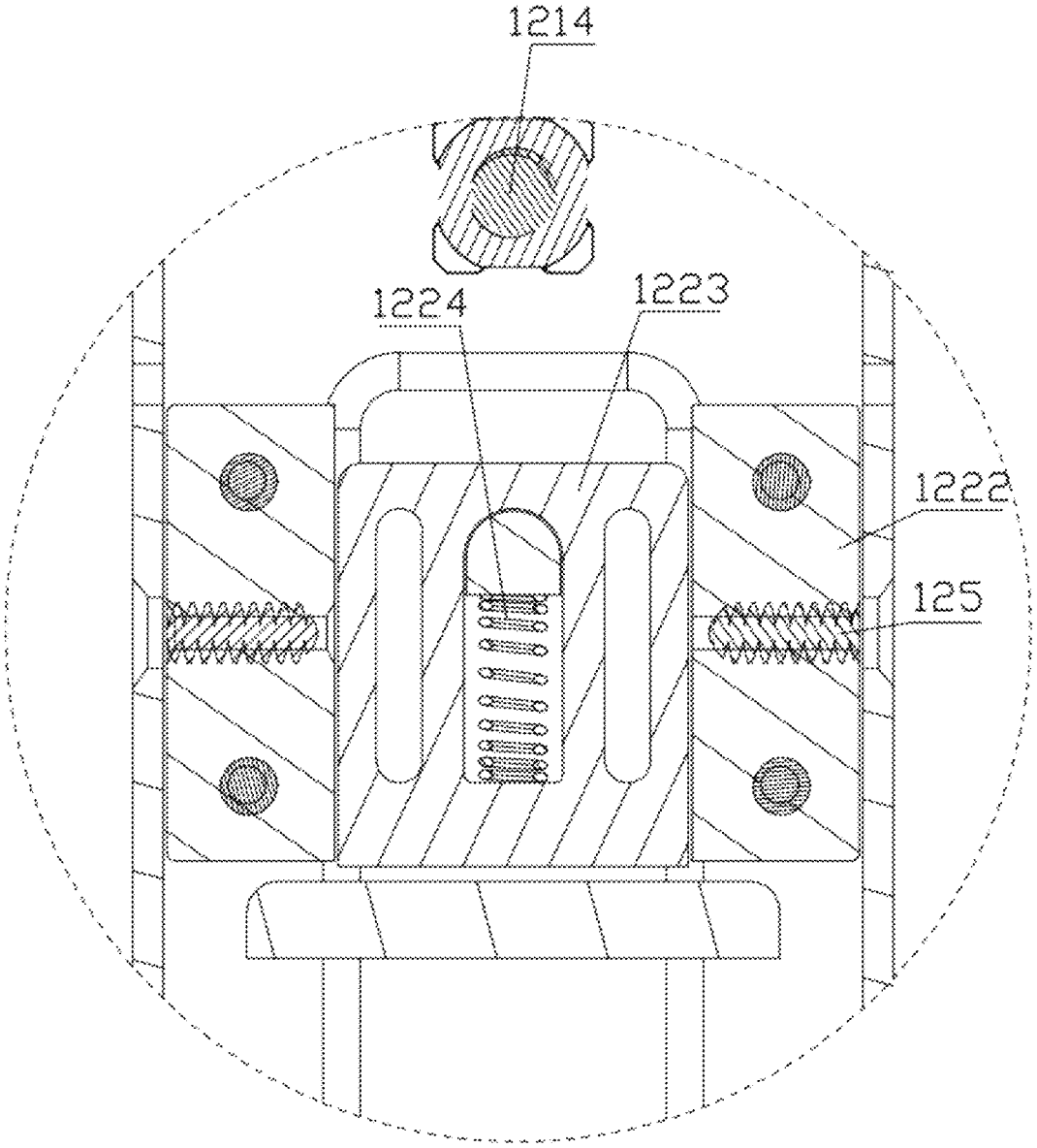
FIG. 7 illustrates an enlarged view of a cross-sectional view of FIG. 1 taken along a line IV-IV.

Referring to FIGS. 6 and 7, FIG. 7 illustrates an enlarged view of a cross-sectional view of FIG. 1 taken along a line IV-IV. The mounting portion 1212 includes a first back plate segment 1212*a* and two adjustment segment sidewalls 1212*b*. The two adjustment segment sidewalls 1212*b* are connected two opposite sides of the first back plate segment 1212*a* respectively. Each adjustment segment sidewall 1212*b* defines an adjust hole 1212*c*. The clastic snapping assembly 122 includes a fixed member 1222, a sliding block 1223 and an clastic member 1224. The fixed member 1222 is fixed to the first back plate segment 1212*a*. The fixed member 1222 defines a hollow space on one side facing the first back plate segment 1212*a*. The sliding block 1223 is received in the hollow space of the fixed member 1222. One end of the elastic member 1224 is resisted the fixed member 1222, and the other end of the clastic member 1224 is resisted the sliding block 1223. The hanging support 12 further includes an adjusting member 125. The adjusting member 125 is screwed into the adjust hole 1212*c*, and is resisted a sidewall of the sliding block 1223. Rotating the adjusting member 125 can adjust a friction force between the adjusting member 125 and the sliding block 1223. When the adjusting member 125 moves toward a side proximate the sidewall of the sliding block 1223, the adjusting member 125 can increase the friction force between the adjusting member 125 and the sliding block 1223. Conversely, when the adjusting member 125 moves toward a side away from the sidewall of the sliding block 1223, the adjusting member 125 can decrease the friction force between the adjusting member 125 and the sliding block 1223. Therefore, the adjusting member 125 can adjust the friction force between the adjusting member 125 and the sliding block 1223. If the friction force between the adjusting member 125 and the sidewall of the sliding block 1223 is comparatively large, when the sliding block 1223 is locked with the snapping protrusion 1242, the sliding block 1223 is less likely to be pushed when subjected to a pushing force provided by the snapping protrusion 1242, such that the hanging support 12 itself can withstand a greater amount of gravity without being susceptible to self-unlocking, and can be configured to hang a heavier display screen. If the friction force between the adjusting member 125 and the sidewall of the sliding block 1223 is comparatively small, the sliding block 1223 is likely to be pushed when subjected to a pushing force provided by the snapping protrusion 1242, such that the hanging support 12 itself can withstand a less amount of gravity and be easily self-unlocked, and can be configured to hang a lighter display screen.

Therefore, by adjusting the amount of the friction force between the adjusting member 125 and the sidewall of the sliding block 1223, can adjust a load-bearing capacity of the hanging support 12, adapted for installation of display screens of different weights.

In some embodiments, the adjusting member 125 is a bumper ball structure. The bumper ball structure can provide a certain degree of cushioning for a sliding friction between the adjusting member 125 the sliding block 1223. In other embodiments, the adjusting member 125 may be other structure capable of realizing a function of resisting, without limitation herein.

Figure 8:
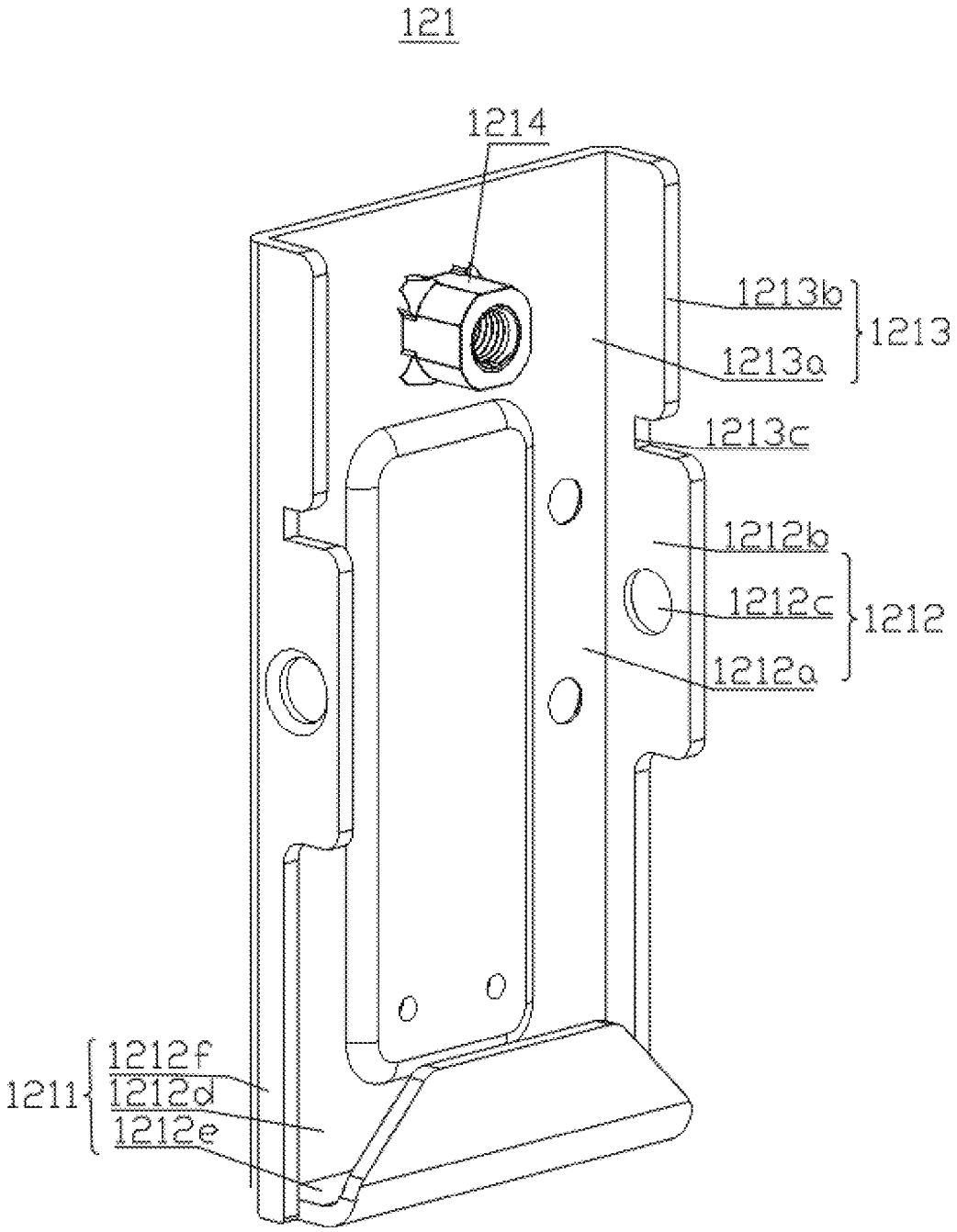
FIG. 8 illustrates a schematic view of a three-dimensional structure of a hook member in accordance with one embodiment of the present disclosure.
Figure 9:
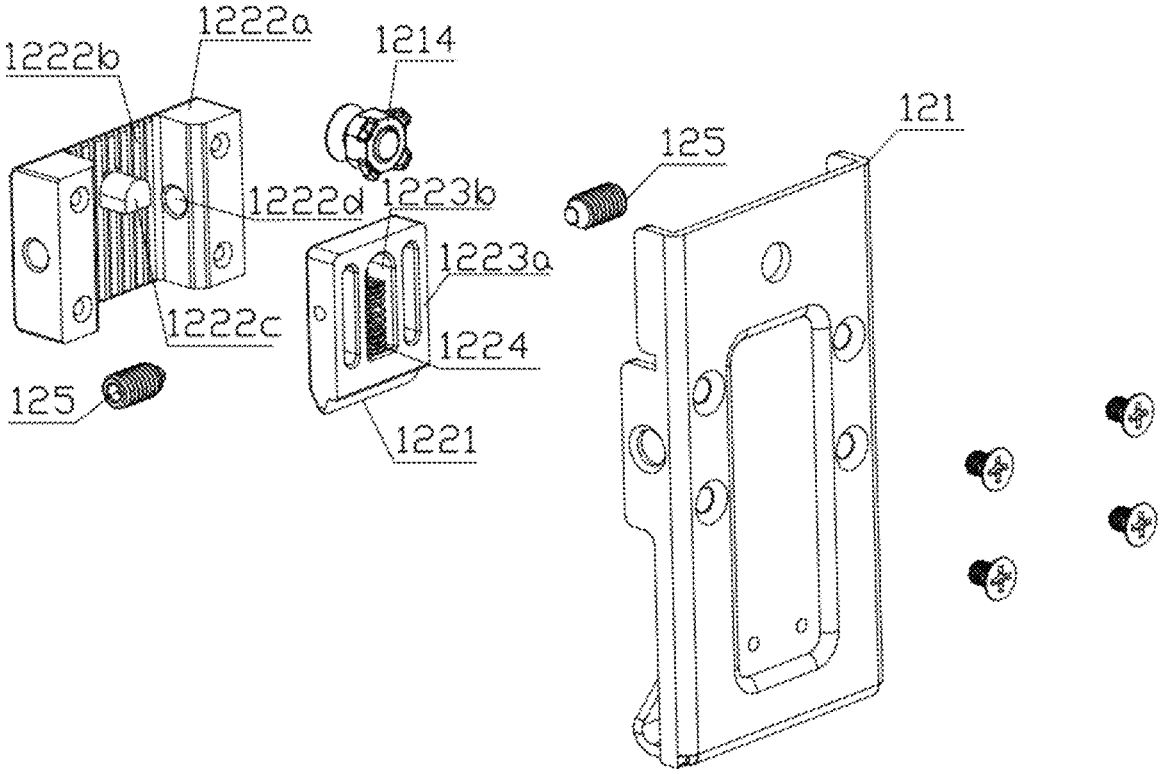
FIG. 9 illustrates a schematic view of a three-dimensional structure of partial structural member of FIG. 6 from another view.

In some embodiments, referring to FIGS. 8 and 9, FIG. 8 illustrates a schematic view of a three-dimensional structure of a hook member 121 in accordance with one embodiment of the present disclosure; FIG. 9 illustrates a schematic view of a three-dimensional structure of partial structural member of FIG. 6 from another view. The fixed member 1222 includes two supporting portions 1222*a* and a cross-connecting portion 1222*b*. The two supporting portions 1222*a* connect to the first back plate segment 1212*a* through the connecting members respectively. The two opposite sides of the cross-connecting portion 1222*b* are connected to the two supporting portions 1222*a* respectively. The fixed member 1222 includes a resisting portion 1222*c* located at a side of the cross-connecting portion 1222*b* close to the hook member 121. The sliding block 1223 includes a sliding body 1223*a* and a grab 1221 connected to one end of the sliding body 1223*a*. The sliding body 1223*a* is received in the hollow space formed by the two supporting portions 1222*a* and the cross-connecting portion 1222*b*. The sliding body 1223*a* defines a receiving hole 1223*b*. When the sliding body 1223*a* is received in the hollow space formed by the two supporting portions 1222*a* and the cross-connecting portion 1222*b*, the resisting portion 1222*c* extends into the receiving hole 1223*b*, the elastic member 1224 is also received in the receiving hole 1223*b*, such that one end of the elastic member 1224 is resisted the resisting portion 1222*c*, and the other end of the elastic member 1224 is resisted one side of the receiving hole 1223*b* away from the resisting portion 1222*c*.

Therefore, the fixed member 1222 of the elastic snapping assembly 122 is fixed to the mounting portion 1212 of the hook member 121, the sliding block 1223 of the elastic snapping assembly 122 is capable of sliding along the height direction of the display mounting support 1, the elastic member 1224 provides an elastic restoring force for an elastic reset of the sliding block 1223.

In some embodiments, the two supporting portions 1222*a* and the cross-connecting portion 1222*b* together form a C-shaped space. In other embodiments, the two supporting portions 1222*a* and the cross-connecting portion 1222*b* together form a H-shaped space or a U-shaped space, without limited herein.

In some embodiments, each supporting portion 1222*a* defines a through hole 1222*d*. The adjusting member 125 passes through the through hole 1222*d* and then abuts against the sidewall of the sliding body 1223*a*.

Therefore, the friction force between the adjusting member 125 and the sliding body 1223*a* can be adjusted by the adjusting member 125.

In some embodiments, the V-shaped structure of the elastic snapping assembly 122 is the grab 1221.

In some embodiments, referring to FIG. 8, the hook portion 1211 includes a second back plate segment 1212*d*, a hook 1212*e*, and two avoidance segment sidewalls 1212*f*. The hook 1212*e* is connected to the second back plate segment 1212*d* in the height direction of the display mounting support 1. The second back plate segment 1212*d* is connected to the first back plate segment 1212*a*. The two avoidance segment sidewalls 1212*f* are connected to the two opposite sides of the second back plate segment 1212*d*, respectively. The two avoidance segment sidewalls 1212*f* are further connected to the two adjustment segment sidewalls 1212*b*, respectively. further The two avoidance segment sidewalls 1212*f* are adjacent to the hook 1212*e*. A length of the adjustment segment sidewall 1212*b* in the front-back direction of the display mounting support 1 (Y-axis direction) is greater than that of the avoidance segment sidewall 1212*f*.

Therefore, on one aspect, the avoidance segment sidewall 1212*f* can increase the overall structural strength of the hook member 121, on the other aspect, the avoidance of the hook portion 1211 makes it easier for the connecting rod 123 to hook into the hook portion 1211.

In some embodiments, the hook member 121 can further include a first connecting portion 1213. The first connecting portion 1213 is connected to one end of the mounting portion 1212 away from the hook portion 1211. Referring to FIG. 2, the wall plate 11 can further includes a plate portion 111 and a second connecting portion 112. The plate portion 111 and the second connecting portion 112 are arranged in the height direction of the display mounting support 1. The plate portion 111 is configured to mount the wall plate 11 to the load-bearing body 3. The second connecting portion 112 is spaced apart at a predetermined distance relative to the load-bearing body 3. The first connecting portion 1213 is inserted into one side of the second connecting portion 112 close to the load-bearing body 3. The first connecting portion 1213 and the second connecting portion 112 are connected by screw fixed members M.

Therefore, compared to the second connecting portion 112 fixed to one side of the wall plate 11 back from the load-bearing body 3, the first connecting portion 1213 is inserted between the load-bearing body 3 and the second connecting portion 112, which can increase an overall structural aesthetics of the display mounting support 1. Of course, in some other embodiments, the second connecting portion 112 can be fixed to one side of the wall plate 11 back from the load-bearding body 3.

In some embodiments, referring to FIGS. 2 and 8, the first connecting portion 1213 includes a third back plate segment 1213*a* and two connecting segment sidewalls 1213*b*. The third back plate segment 1213*a* is connected to the first back plate segment 1212*a*. The two connecting segment sidewalls 1213*b* are connected two opposite sides of the adjustment segment 1213*a*, respectively. A bayonet 1213*c* is defined between one connecting segment sidewall 1213*b* and one adjustment segment sidewall 1212*b*. A bottom end of the second connecting portion 112 includes a folding edge 112*a*. When the first connecting portion 1213 is inserted into one side of the second connecting portion 112 close to the load-bearing body 3, the folding edge 112*a* is snapped with the bayonet 1213*c*.

Therefore, on one aspect, the structural strength of the wall plate 11 can be increased, on the other aspect, the connection strength between the hook member 121 and the wall plate 11 can be increased.

In some embodiments, referring to FIGS. 2 and 8 again, the hook member 121 further include a nut column 1214. The nut column 1214 is connected to the third back plate segment 1213*a*. The nut column 1214 is resisted the back surface of the second connecting portion 112. The second connecting portion 112 defines a plurality of connect holes 1121. The screw fixed member M penetrates through the connect hole 1121 of the second connecting portion 112 and then screwed with the nut column 1214.

Therefore, the nut column 1214 can provide enough screw length support for the screw fixed member M to connect the second connecting portion 112 and the hook member 121, which can make the connection between the second connecting portion 112 and the hook member 121 more stable and reliable.

Figure 10:
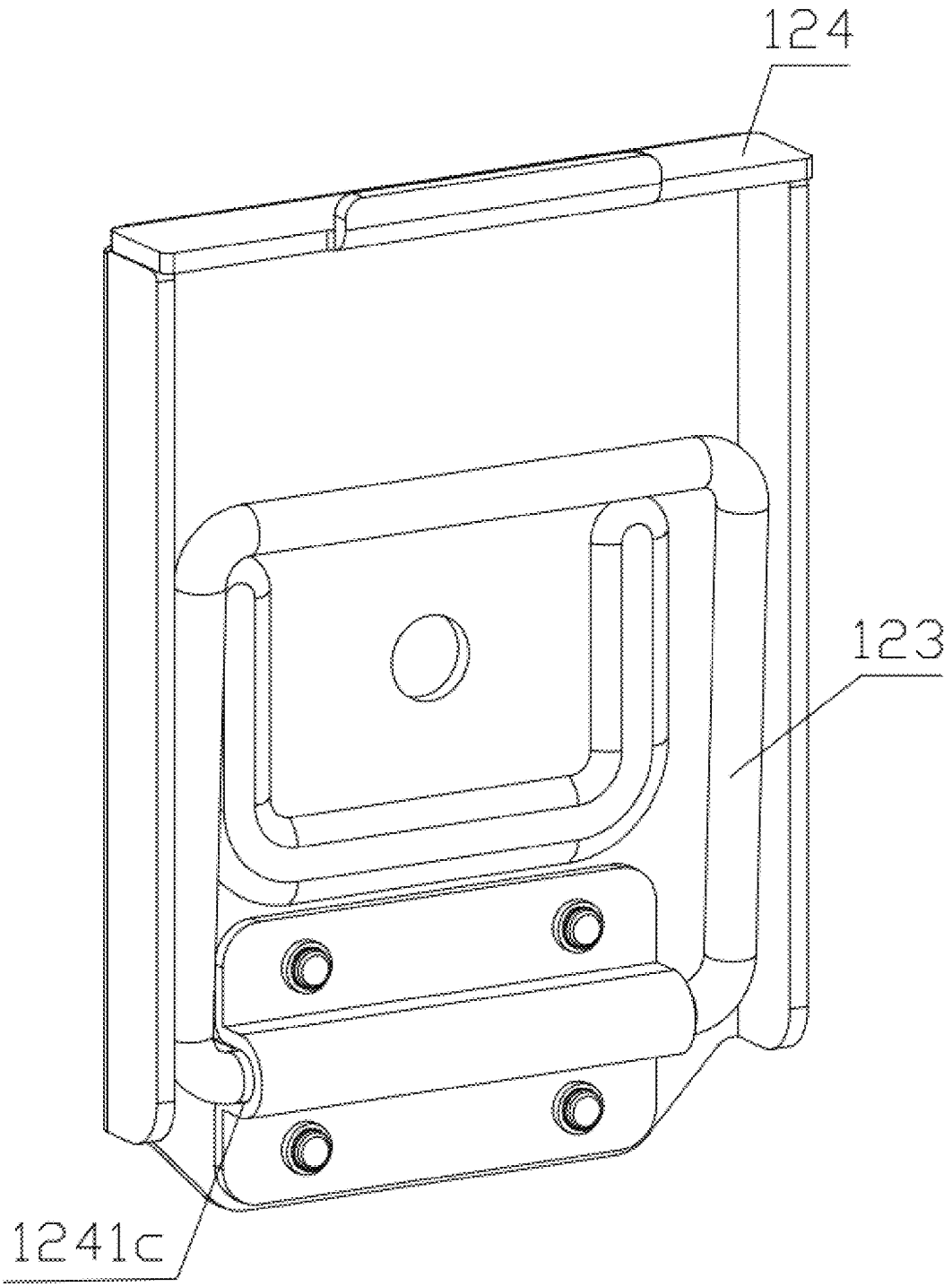
FIG. 10 illustrates a schematic view of a three-dimensional structure of a hanging member connecting with a connecting rod through a connecting portion in accordance with one embodiment of the present disclosure.
Figure 11:
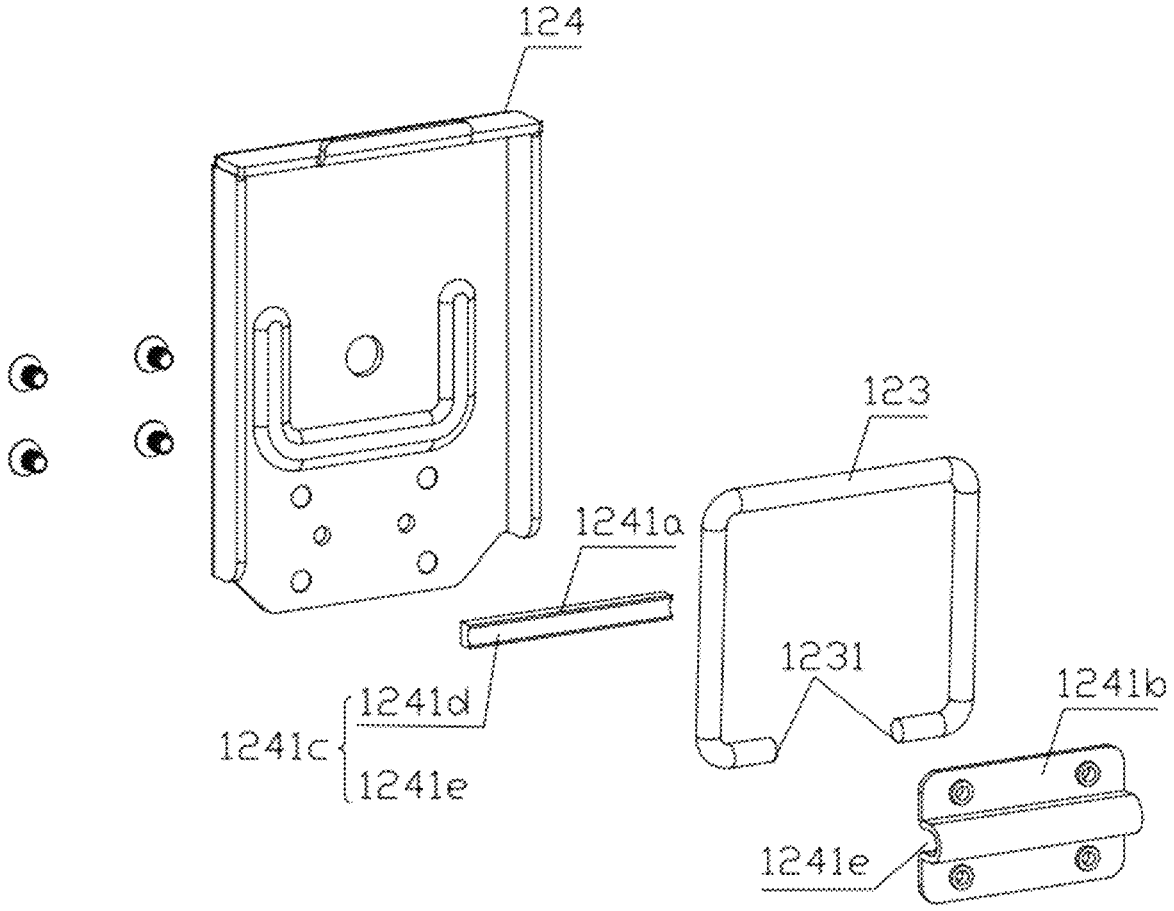
FIG. 11 illustrates an exploded view of FIG. 10.

Referring to FIGS. 10 and 11, the connecting portion 1241 includes a first resisting member 1241*a* and a second resisting member 1241*b*. The first resisting member 1241*a* is connected to the back surface of the hanging member 124. The second resisting member 1241*b* is also connected to the back surface of the hanging member 124. The first resisting member 1241*a* is located between the second resisting member 1241*b* and the hanging member 124. The first resisting member 1241*a* and the second resisting member 1241*b* cooperatively form a hole 1214*c*. One end of the connecting rod 123 connected to the hanging member 124 is connected within the hole 1241*c*. There is sufficient friction force between the hole 1241*c* and the connecting rod 123 to cause the connecting rod 123 and the hanging member 124 to maintain a certain angle under gravity; the back surface of the hanging member 124 refers to a surface of the hanging member 124 that is back from the display screen.

Therefore, when the hanging member 124 connected with the connecting rod 123 is mounted on the back surface of the display screen, the display screen is carried such that the connecting rod 123 located at the back surface of the display screen is aligned with the hook portion 1211 of the hook member 121, the connecting rod 123 can be kept at a preset angle to facilitate to hang the connecting rod 123 on the back surface of the display screen into the hook portion 1211 of the hook member 121, for ease of mounting.

In some embodiments, the first resisting member 1241*a* defines a first arc-shaped portion 1241*d*, the second resisting member 1241*b* defines a second arc-shaped portion 1241*e*. The first arc-shaped portion 1241*d* and the second arc-shaped portion 1241*e* cooperatively form the circular hole 1241*c*, for ease of mounting.

In some embodiments, the second resisting member 1241*b* is a metal member and the first resisting member 1241*a* is a plastic member.

Therefore, the second resisting member 1241*b* can increase the structural strength of the hole 1241*c* as a whole, the hanging member 124 can also increase the structural strength of the hole 1241*c* as a whole; and the first resisting member 1241*a* can have a cushioning effect on an impact between the second resisting member 1241*b* and the connecting rod 123, due to its location between the second resisting member 1241*b* and the connecting rod 123.

In some embodiments, the second resisting member 1241*b* may be, but is not limited to, a strip of plastic, the first resisting member 1241*a* may be, but is not limited to, a U-shaped spacer, the connecting rod 123 is in a form of a square ring. One side of the connecting rod 123 is disconnected to form two inserting ends 1231. The two inserting ends 1231 are inserted into opposite ends of the hole 1241*c* respectively. In other embodiments, the connecting rod 123 may be in a form of a ring connected on all sides or other structures, which are not limited herein.

When mounting, firstly, the second resisting member 1241*b* is connected to the back surface of the hanging member 124 by using screw fixed members, secondly, the second resisting member 1241*b* is connected to the back surface of the hanging member 124 by using screw fixed members, the second resisting member 1241*b* is also resisted the first resisting member 1241*a*, finally, the two inserting ends 1231 of the connecting rod 123 are inserted into two opposite ends of the hole 1241*c*, for case of mounting.

Figure 12:
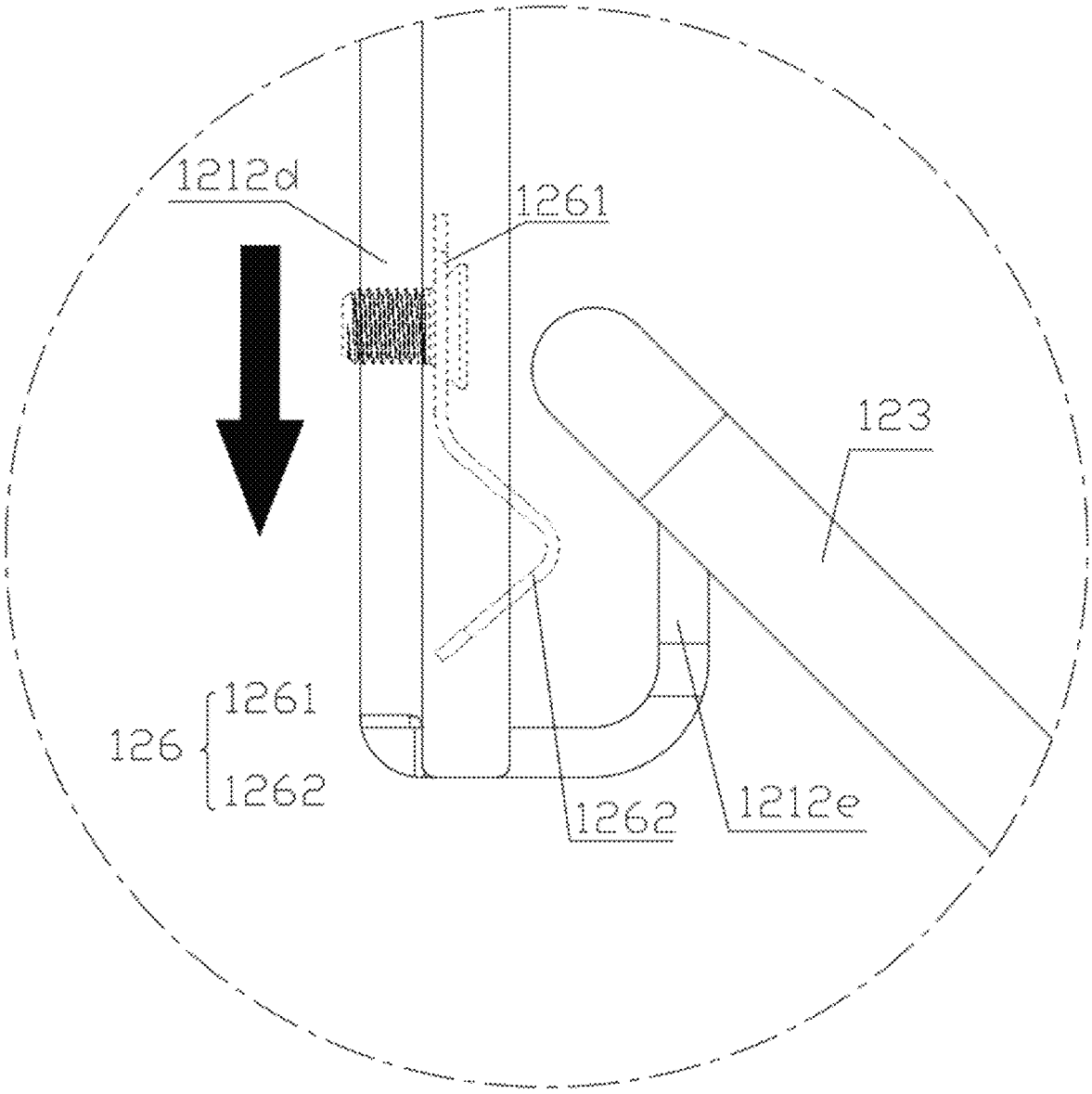
FIG. 12 illustrates a schematic view of a connecting rod being separated from a snapping piece in accordance with one embodiment of the present disclosure.

In some embodiments, referring to FIGS. 6 and 12, the hanging support 12 further includes a snapping piece 126. The snapping piece 126 is mounted on the second back plate segment 1212*d*. When the connecting rod 123 is hung into the hook portion 1211, the connecting rod 123 is snapped with the snapping piece 126.

Therefore, when the display mounting support 1 is in the unlocked state, the connecting rod 123 is less likely to slide out of the hook portion 1211, which can ensure the security of the display screen to a certain extent.

In some embodiments, the snapping piece 126 includes a fixed portion 1261 and a snapping portion 1262. The fixed portion 1261 is connected to the second back plate segment 1212*d*. The snapping portion 1262 is bent and re-bent from the fixed portion 1261 to form a V-shaped structure. The snapping portion 1262 is located within the hook 1212*e*. A width of a channel formed between the snapping portion 1262 and the hook 1212*e* is less than an outer diameter of a rod body of the connecting rod 123, and passage of the connecting rod 123 through the channel requires an elastic deformation of the snapping portion 1262 squeezed by the connecting rod 123 to widen the channel in order for the connecting rod 123 to pass through the channel.

When mounting, firstly, the hanging member 124 mounted with the connecting rod 123 is mounted to the back surface of the display screen, an angle between the connecting rod 123 and the hanging member 124 is adjusted; secondly, the display screen connected with the hanging member 124 and the connecting rod 123 is lift up so that the connecting rod 123 is directly opposite an opening of the hook portion 1211, the connecting rod 123 is placed into the opening of the hook portion 1211; thirdly, the display screen is pulled down by a force or a gravity of the display screen itself, causing the connecting rod 123 to squeeze the snapping portion 1262 of the snapping piece 126 and undergoes elastic deformation, and when a "snap" sound is heard, it is indicated that the connecting rod 123 snaps with the snapping portion 1262 of the snapping piece 126. When the connecting rod 123 is snapped with the snapping portion 1262, the snapping portion 1262 can play a limiting role, which can ensure the safety of the display screen to a certain extent.

Figure 13:
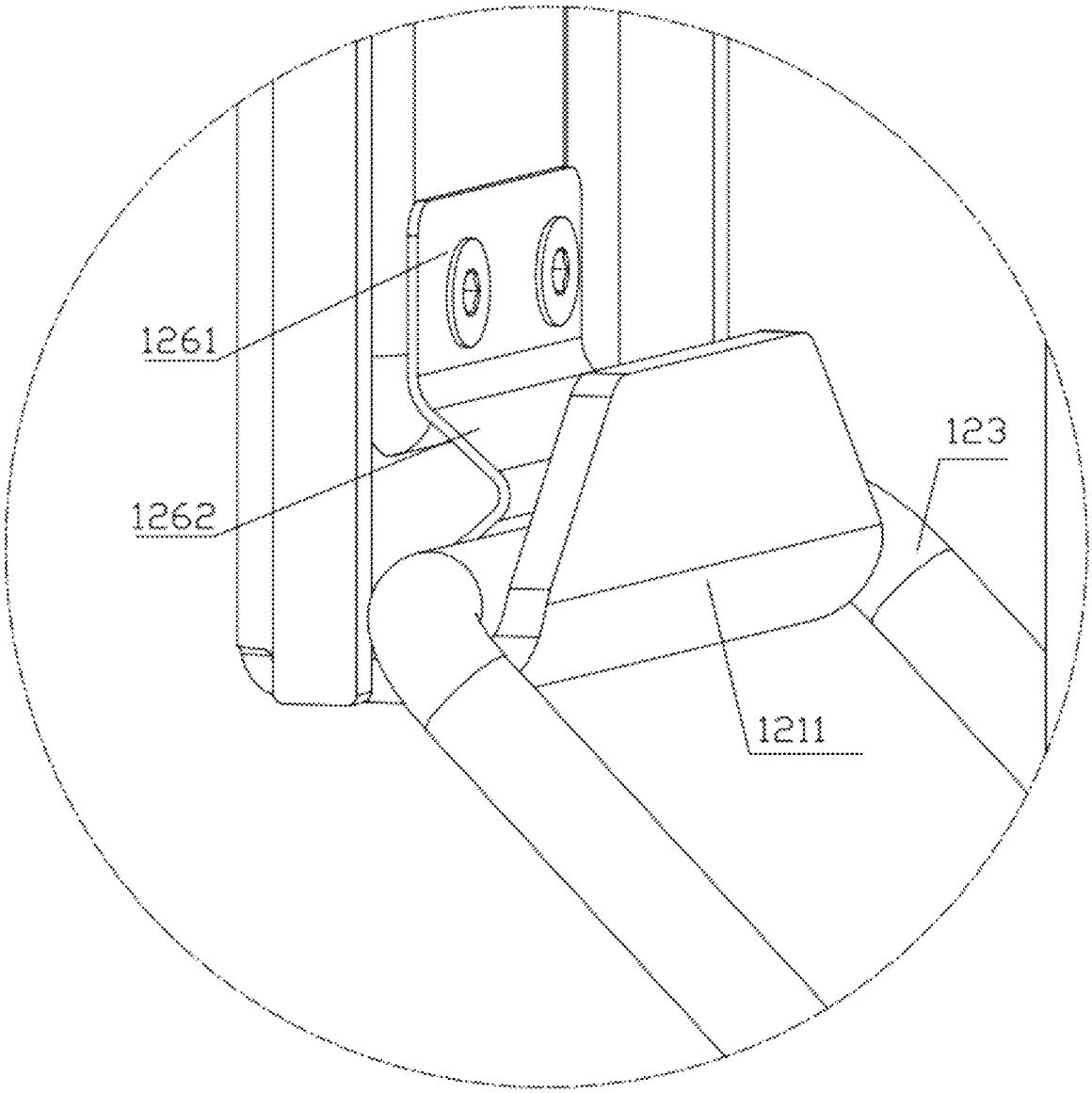
FIG. 13 illustrates a schematic view of the connecting rod being snapped with the snapping piece in accordance with one embodiment of the present disclosure.
Figure 14:
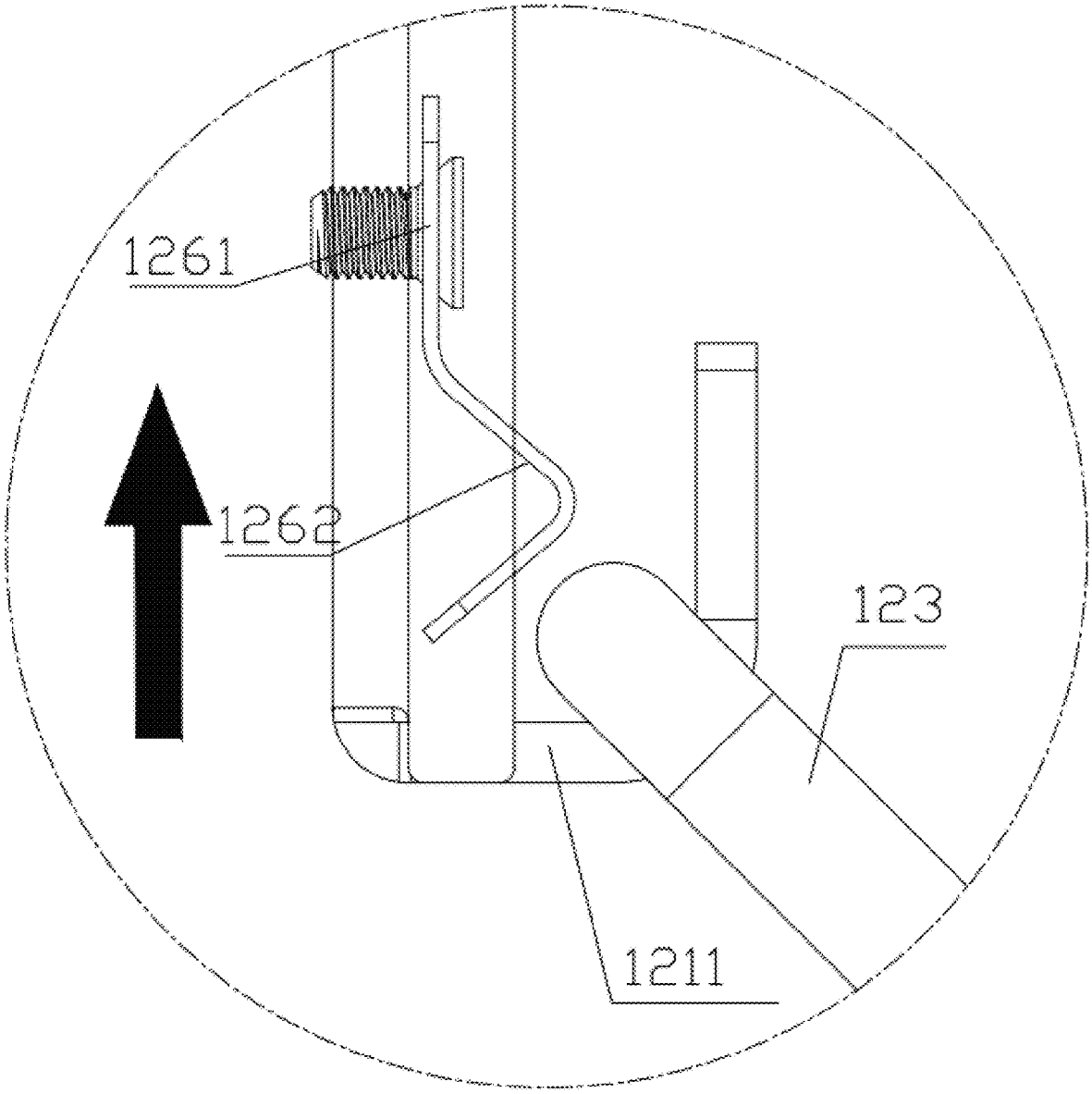
FIG. 14 illustrates a schematic view of the connecting rod being pushed upward so as to separate from the snapping piece in accordance with one embodiment of the present disclosure.
Figure 15:
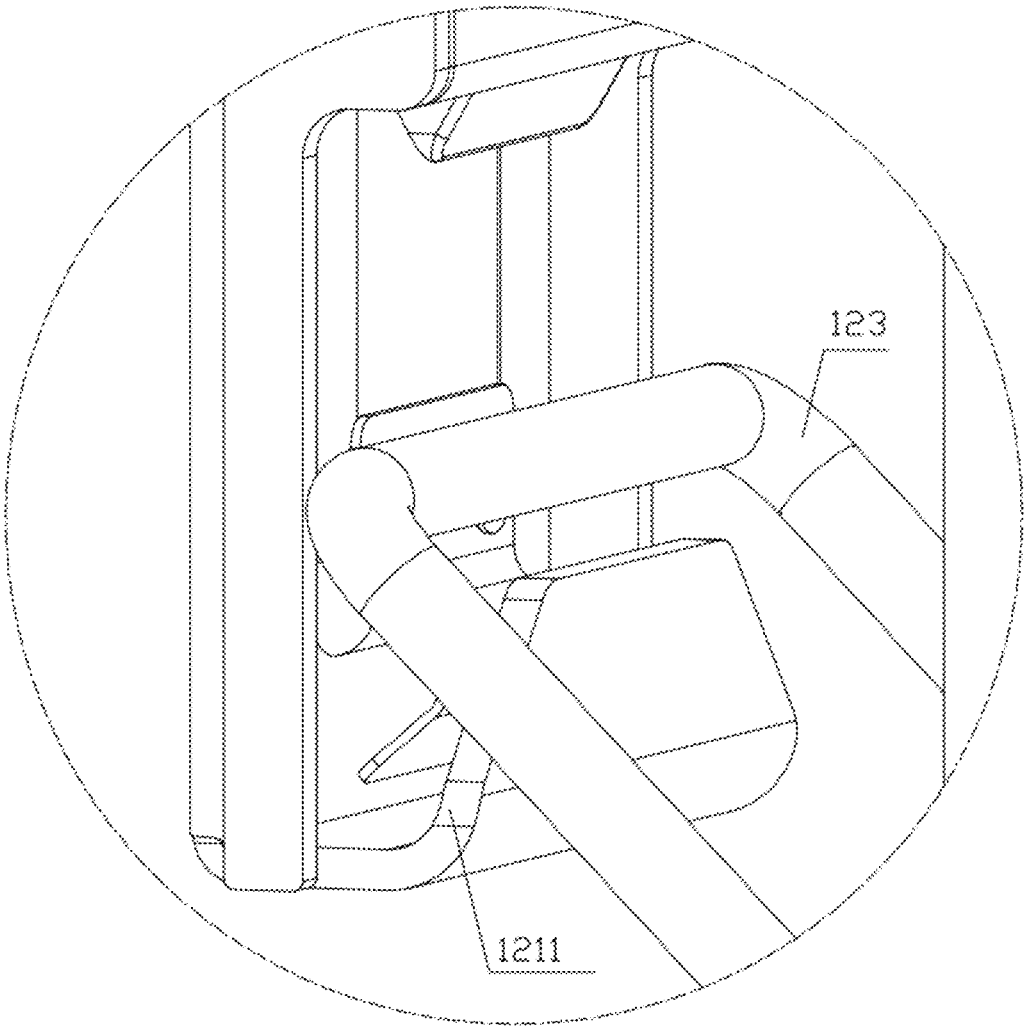
FIG. 15 illustrates a schematic view of the connecting rod being separated from the snapping piece in accordance with one embodiment of the present disclosure.

Referring to FIGS. 13, 14 and 15, when it is necessary to remove the connecting rod 123 from the hook portion 1211, lifting the display screen upwardly causes the connecting rod 123 to squeeze the snapping portion 1262 such that the snapping portion 1262 is elastically deformed and thereby the connecting rod 123 can pass through the channel formed between the snapping portion 1262 and the hook portion 1211, and then the connecting rod 123 may be removed from the hook portion 1211.

Figure 16:
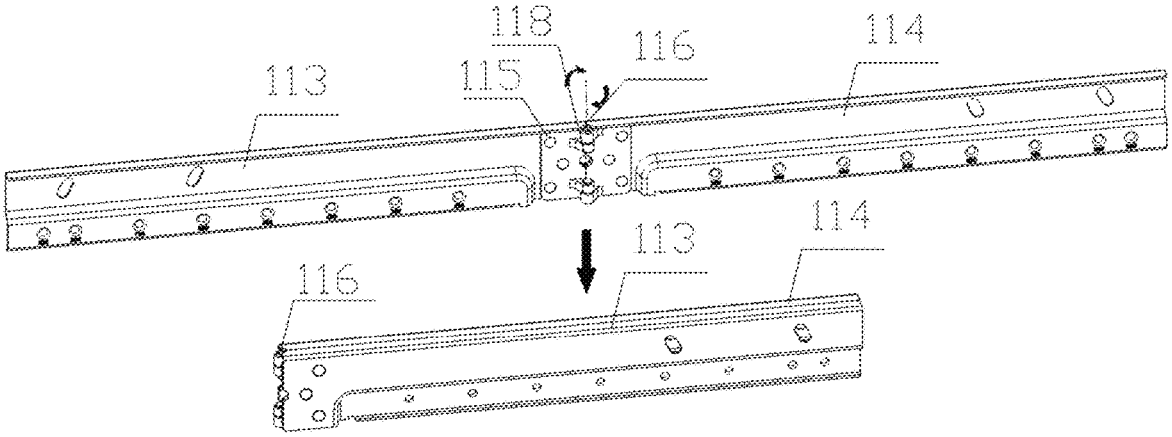
FIG. 16 illustrates an unfolded schematic view and a folded schematic view of a wall plate in accordance with one embodiment of the present disclosure.

In some embodiments, referring to FIG. 16, the wall plate 11 further includes a first wall plate 113, a second wall plate 114 and a hinged piece 115. The first wall plate 113 is hinged to the second wall plate 114 in the left-right direction of the display mounting support 1 by using the hinged piece 115.

Therefore, the wall plate 11 can be folded and stowed for easy logistics and transportation, and the first wall plate 113 and the second wall plate 114 are hingedly connected to each other, also facilitating on-site mounting.

In some embodiments, one end of the first wall plate 113 adjacent to the second wall plate 114 includes a resisting surface 116, one end of the second wall plate 114 adjacent to the first wall plate 113 also includes a resisting surface 116. When the first wall plate 113 and the second wall plate 114 are hinged by the hinged piece 115, the resisting surface 116 of the first wall plate 113 and the resisting surface 116 of the second wall plate 114 are resisted with each other, the first wall plate 113 and the second wall plate 114 have a 180-degree opening and closing angle between them, rather than a 360-degree opening and closing angle.

Therefore, when the first wall plate 113 and the second wall plate 114 are fixed to the load-bearing body 3, the resisting surface 116 of the first wall plate 113 and the resisting surface 116 of the second wall plate 114 are resisted with each other, and do not be deformed toward a side away from the load-bearing body 3 due to the suspension of the display screen.

In some embodiments, the wall plate 11 defines a center hole 118. The center hole 118 penetrates through the hinged piece 115, the first wall plate 113 and the second wall plate 114.

Therefore, the center hole 118 can be configured for pre-positioning or, alternatively, secured to a wooden post that is located just in a middle of a mounting position of the display mounting support 1, extending the scenarios of use of the display mounting support 1.

In some embodiments, the first wall plate 113 and the second wall plate 114 are all designed to be S-shaped structure, in addition to positions of the first wall plate 113 and the second wall plate 114 for mounting the hinged piece 115, that is, projections of the first wall plate 113 and the second wall plate 114 on a YZ plane are substantially S-shaped. It can be understood that, S-shaped structure can enhance the structural strength of the first wall plate 113 and the second wall plate 114, and provide mounting space for the hook member 121, which can reduce the overall thickness of the display mounting support 1, i.e. reduce the distance of the display mounting support 1 from the load-bearing body 3.

In some embodiments, the first wall plate 113 and the second wall plate 114 are both designed to be flat at one adjacent end to facilitate mounting of the hinged piece 115.

Figure 17:
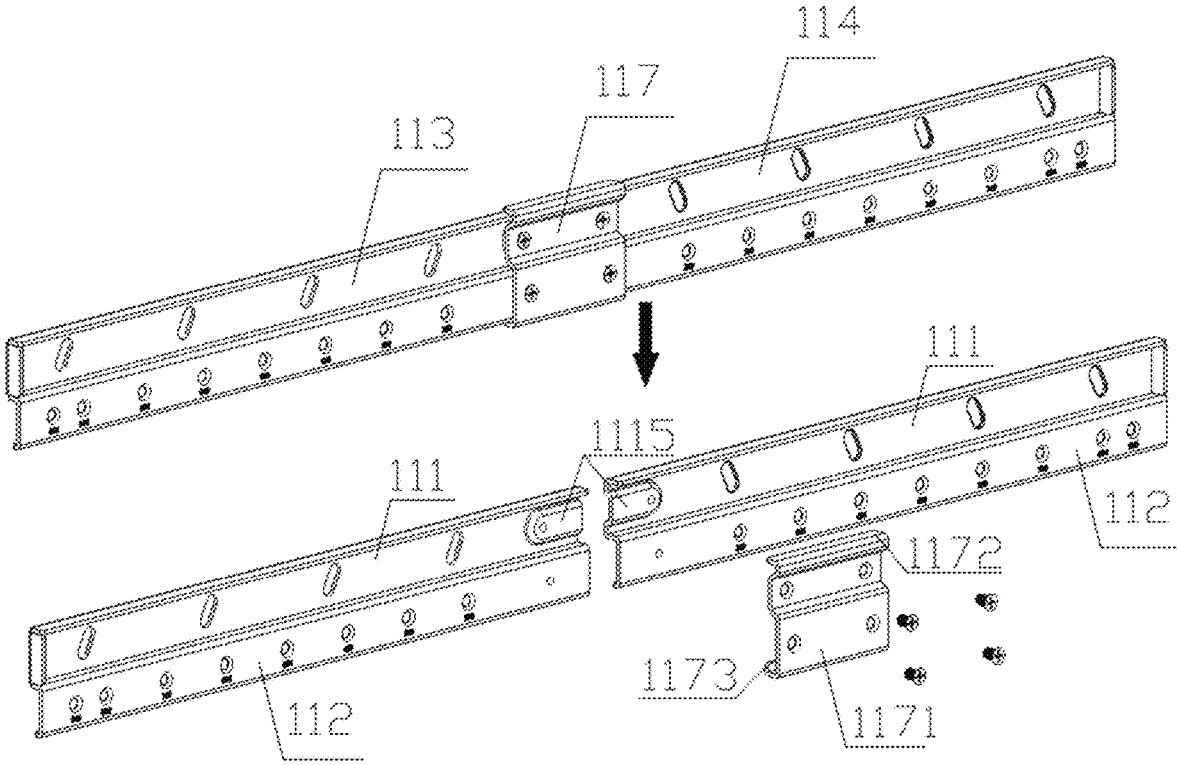
FIG. 17 illustrates an assembly schematic view and a disassembly schematic view of a wall plate in accordance with another embodiment of the present disclosure.

Referring to FIG. 17, FIG. 17 illustrates an assembly schematic view and a disassembly schematic view of a wall plate in accordance with another embodiment of the present disclosure. In this embodiment, the wall plate 11 includes a first wall plate 113, a second wall plate 114 and a connecting member 117. The first wall plate 113 is connected to the second wall plate 114 in the left-right direction of the display mounting support 1 by using the connecting member 117.

Thereby, the wall plate 11 can be folded and stowed for easy logistics and transportation.

In some embodiments, the projection of the first wall plate 113 on the YZ plane is substantially S-shaped, the projection of the second wall plate 114 on the YZ plane is also substantially S-shaped. One end of the first wall plate 113 adjacent to the second wall plate 114 includes a protrusion 1115, one end of the second wall plate 114 adjacent to the first wall plate 113 includes a protrusion 1115, the protrusions 1115 make a surface drop between the first connecting portion 1213 and the second connecting portion 112 to be reduced, to facilitate mounting the connecting member 117 on adjacent ends of the first wall plate 113 and the second wall plate 114, so as to connect the first wall plate 113 and the second wall plate 114.

In some embodiments, the connecting member 117 includes a S-shaped portion 1171, a first bending portion 1172 and a second bending portion 1173. The S-shaped portion 1171 is connected between the first bending portion 1172 and the second bending portion 1173. The S-shaped portion 1171 adapts to a shape of the plate portion 111 and a shape of the second connecting portion 112 of both the first wall plate 113 and the second wall plate 114, the first bending portion 1172 extends from one end of the S-shaped portion 1171 in a bend, and the second bending portion 1173 extends from the other end of the S-shaped portion 1171 in a bend and again bends upward.

Accordingly, the structure of the connecting member 117 is adapted to the structure of the first wall plate 113 and the second wall plate 114 in the height direction of the display mounting support 1, further enhancing the connection strength of the connecting member 117 to the first wall plate 113 and the second wall plate 114.

In some embodiments, the wall plate 11 defines a center hole 118. The center hole 118 penetrates through the connecting member 117, the first wall plate 113 and the second wall plate 114.

Therefore, the center hole 118 is configured to pre-positioning, or alternatively, secured to a wooden post that is located just in a middle of a mounting position of the display mounting support 1, extending the scenarios of use of the display mounting support 1.

Figure 18:
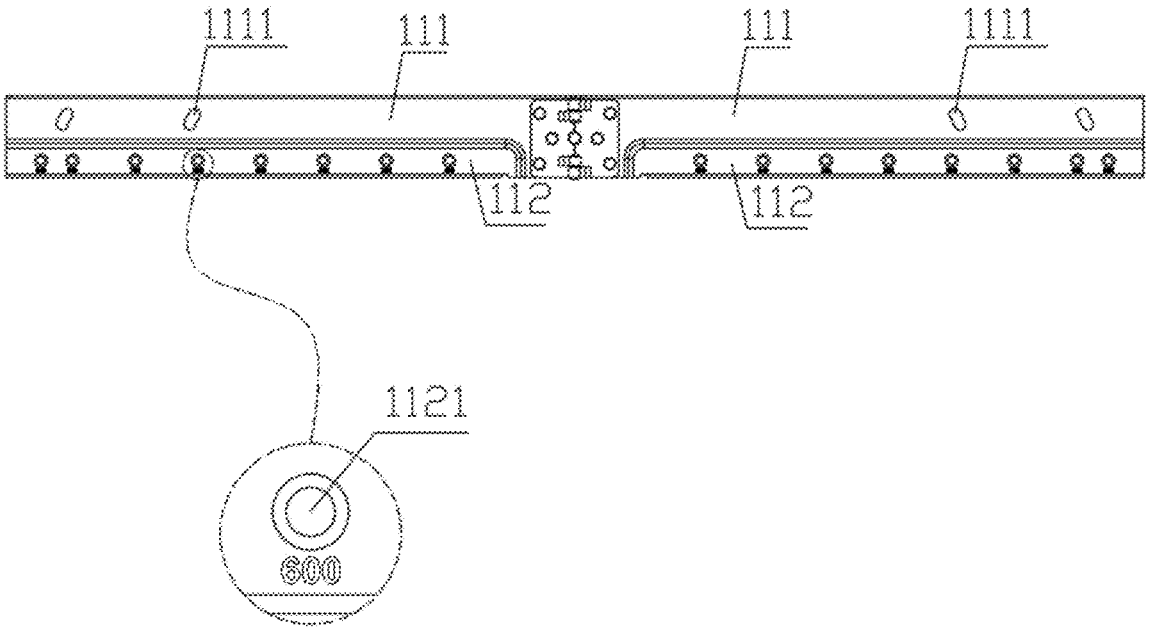
FIG. 18 illustrates a front view of a wall plate and an enlarged view of the wall plate in accordance with one embodiment of the present disclosure.

In some embodiments, referring to FIG. 18, each connect hole 1121 is further marked with a scale around it, and two connect holes 1121 symmetrically left and right with respect to the center of the wall plate 11 have the same marking scale.

When mounting, the first wall plate 113 is mounted by selecting a connect hole 1121 with a corresponding scale on the first wall plate 113, and the second wall plate 114 is mounted by selecting a connect hole 1121 with a same scale on the second wall plate 114. The scales on the first wall plate 113 and the second wall plate 114 allow the user to quickly see the distance between the corresponding connect holes 1121 of the first wall plate 113 and the second wall plate 114, eliminating the need to measure, simplifying the installation steps.

In some embodiments, referring to FIG. 18 again, the plate portion 111 defines a plurality of strip mounting holes 1111, the plurality of strip mounting holes 1111 are disposed at an angle with respect to a vertical symmetry axis of the wall plate 11, and the plurality of strip mounting holes 1111 are disposed symmetrically with respect to the vertical symmetry axis of the wall plate 11.

Figure 19:
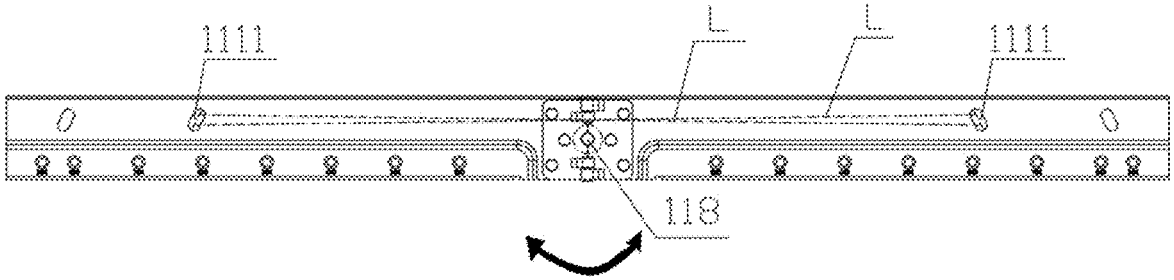
FIG. 19 illustrates a schematic view of a mounting location of fasteners in strip mounting holes of the wall plate in accordance with one embodiment of the present disclosure.

In some embodiments, referring to FIG. 19, the strip mounting hole 1111 is either a straight hole or an arcuate hole centered on the center hole 118 of the wall plate 11. A length L of a line connecting a top of one strip mounting hole 1111 of a pair of symmetrically disposed strip mounting holes 1111 with a bottom of another strip mounting hole 1111 of the pair of symmetrically disposed strip mounting holes 1111 is equal to a length L of a line connecting the center of the pair of symmetrically disposed strip mounting holes 1111.

Therefore, when the wall plate 11 is mounted on the load-bearing body 3 in a tilted state, the position of the fasteners within the strip mounting holes 1111 can be adjusted, thereby adjusting the levelness of the wall plate 11, so that the wall plate 11 is in a horizontal state as a whole.

Figure 20:
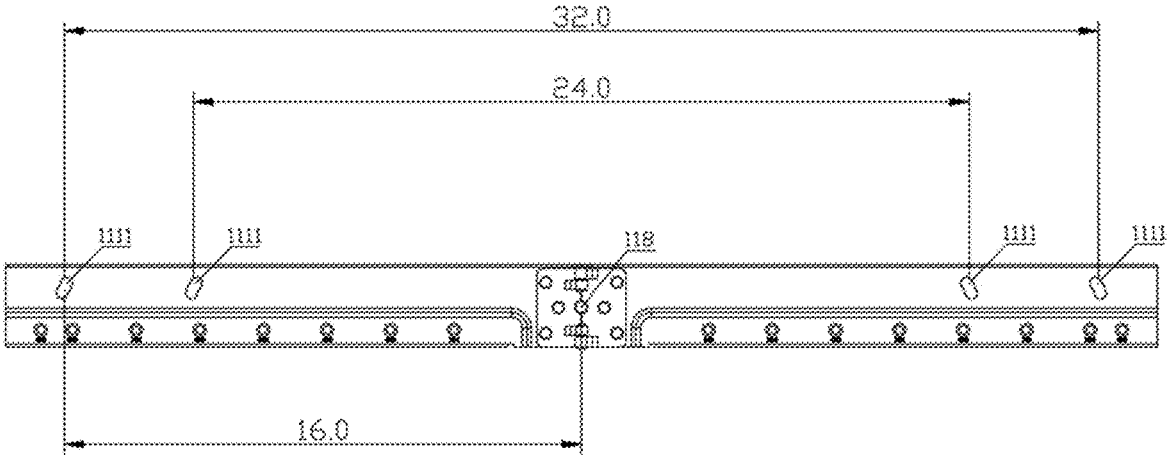
FIG. 20 illustrates a schematic view of lengths of the wall plate in accordance with one embodiment of present disclosure.

In some embodiments, referring to FIG. 20, a spacing between the center hole 118 and the outermost strip mounting hole 1111 is 16 inches, a spacing between the inner pair of strip mounting holes 1111 is 24 inches, and a spacing between the outer pair of strip mounting holes 1111 is 36 inches, and the display mounting support 1 of the present disclosure can be applied to the mounting of a wood stud wall with a spacing of 16 inches, 24 inches, 32 inches, and so on.

Figure 21:
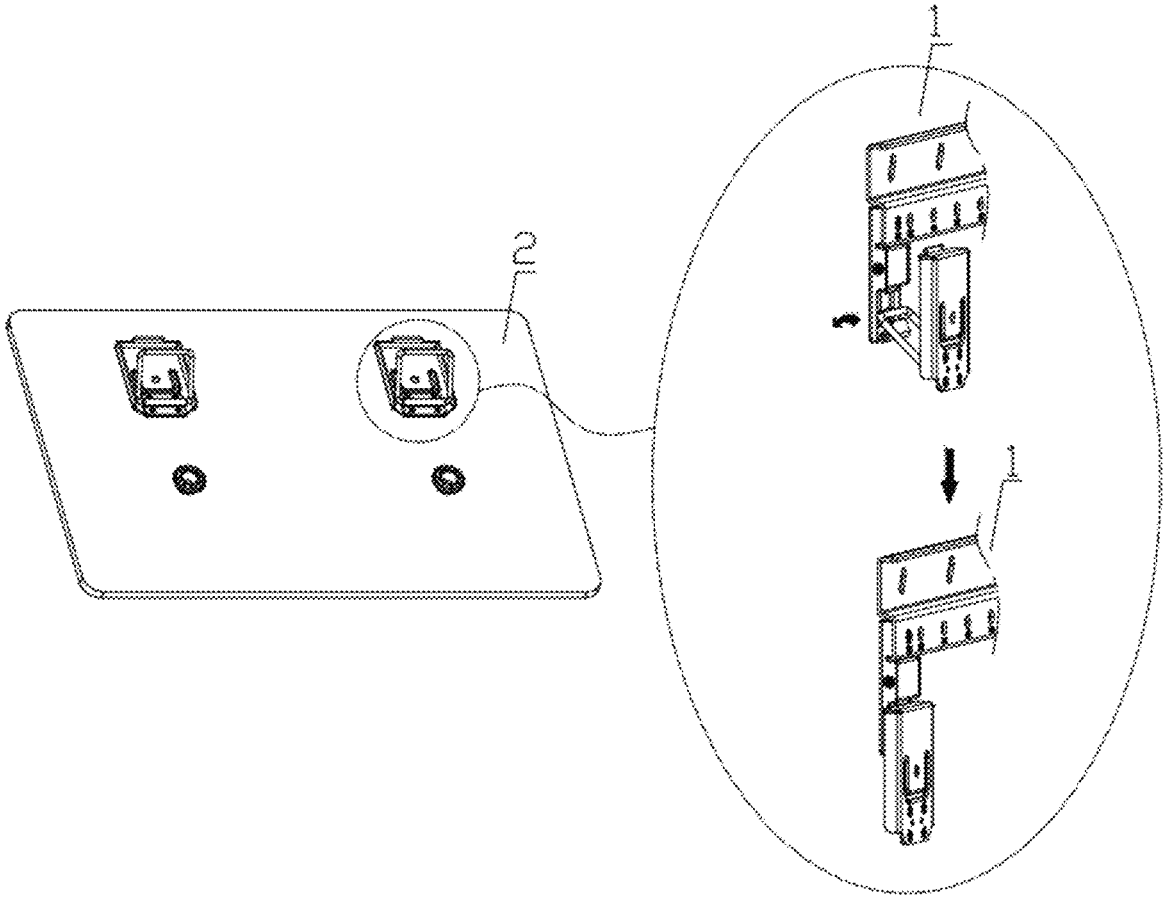
FIG. 21 illustrates a schematic view of mounting a display screen using the display mounting support in accordance with one embodiment of present disclosure.

Referring to FIG. 21, FIG. 21 illustrates a schematic view of mounting display screen 2 using the display mounting support 1 in accordance with one embodiment of present disclosure. When mounting, the assembly of the hanging member 124 and the connecting rod 123 are mounted on the back surface of the display screen 2, and the connecting rod 123 is adjusted to be tilted upward so that the angle between the connecting rod 123 and the hanging member 124 is an acute angle. The assembly of the wall plate 11, the hook member 121 and the elastic snapping assembly 122 are mounted on the load-bearing body 3. The display screen 2 is lifted so that the back surface of the display screen 2 faces the load-bearing 3, the connecting rod 123 is aligned with the hook of the hook member 121, and after hearing a "snap", the display screen is pushed towards the load-bearing body 3, so that the snapping protrusion 1242 of the hanging member 124 is snapped with the elastic snapping assembly 122, and the mounting is completed.

Figure 22:
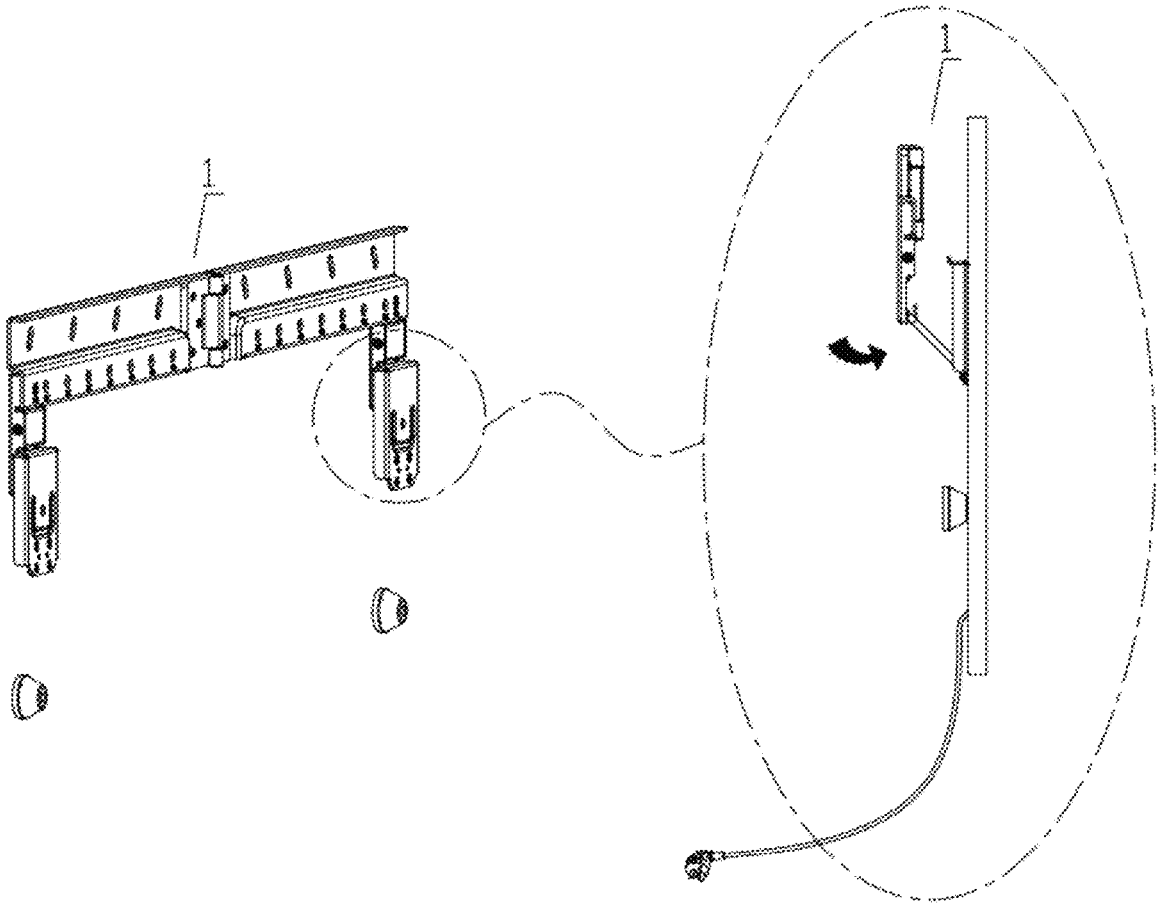
FIG. 22 illustrates a schematic view of the display mounting support in accordance with one embodiment of present disclosure in which the display mounting support is in the unlocked state.

Referring to FIG. 22, FIG. 22 illustrates a schematic view of the display mounting support 1 in accordance with one embodiment of present disclosure in which the display mounting support 1 is in the unlocked state. The display mounting support 1 is in the unlocked state, the display screen can be pulled toward a side away from the load-bearing body 3 at an angle, so that the spacing between the back surface of the display screen and the load-bearing body 3 increases, and the operations such as plugging a power cord or so on can be operated in the spacing between the back surface of the display screen and the load-bearing body 3.

Figure 23:
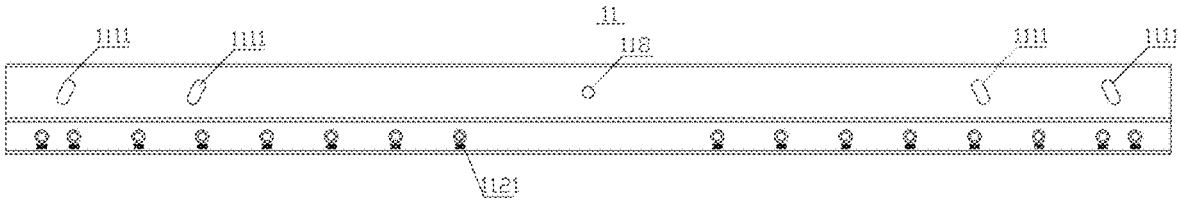
FIG. 23 illustrates a front view of the wall plate in accordance with another embodiment of present disclosure.

Referring to FIG. 23, FIG. 23 illustrates a front view of the wall plate in accordance with another embodiment of present disclosure. Unlike the previous embodiment, in this embodiment, said wall plate 11 is a one-piece structure, and the wall plate 11 having one-piece structure can have better structural strength.

Figure 24:
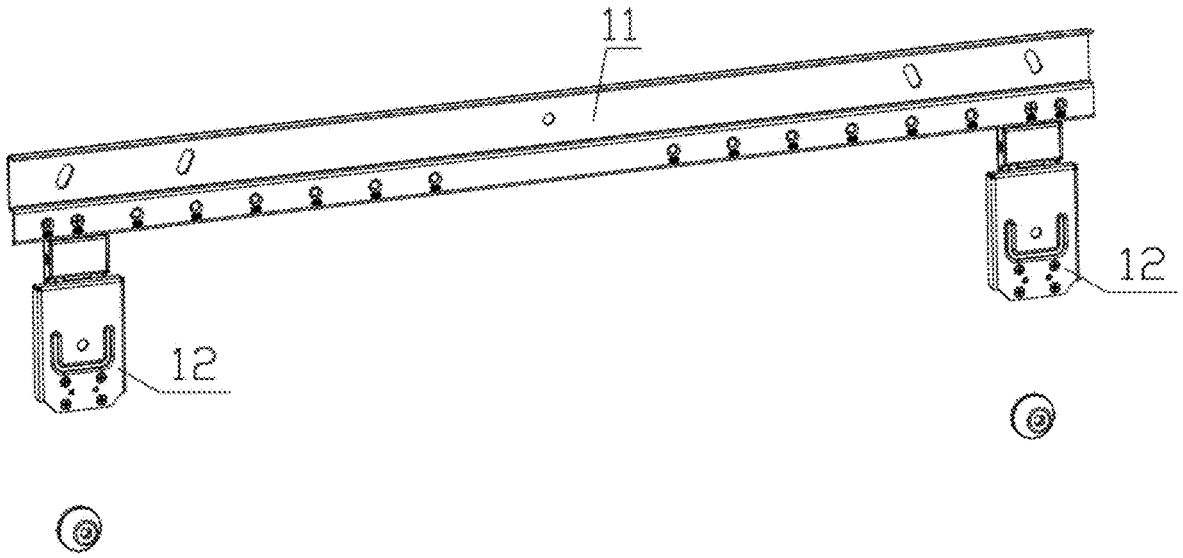
FIG. 24 illustrates a schematic view of a three-dimensional structure of the display mounting support in accordance with another embodiment of the present disclosure.

Referring to FIG. 24, FIG. 24 illustrates a schematic view of a three-dimensional structure of the display mounting support in accordance with another embodiment of the present disclosure. In this embodiment, the display mounting support 1 also adopts a one-piece structure wall plate 11.

The above technical solutions to the subject matter of the present disclosure and the corresponding details are introduced, it can be understood that the above introduction is only some of the embodiments of the subject matter of the technical solutions of the present disclosure, and some of the details can be omitted in its specific implementation.

In addition, in some embodiments of the above present disclosure, there are multiple embodiments of the combination of implementation possibilities, various combination programs are limited to space will not be listed. The technical personnel in the field can freely combine the implementation of the above embodiments according to the needs of the specific implementation, in order to obtain a better application experience.

In summary, it can be seen that this application has the above mentioned excellent characteristics, so that it can be configured to enhance the effectiveness of the previous technology has not been practical, and become a very practical value of the product.

The above is only a better example of this application, and is not intended to limit this application. Any modification, equivalent replacement or improvement made within the ideas and principles of this application shall be included in the scope of protection of this application.

What is claimed is:

1. A display mounting support, wherein the display mounting support comprises:

a wall plate configured to be fixed to a load-bearing body; and a hanging support comprising:

a hook member being mounted on the wall plate and comprising a hook portion;

an elastic snapping assembly, a partial structure of the elastic snapping assembly being stationary relative to the hook member, another structure of the elastic snapping assembly being capable of stretching out and drawing back along a height direction of the display mounting support;

a connecting rod; and a hanging member being configured to be connected with a display screen and comprising a connecting portion and a snapping protrusion, the connecting portion being connected to one end of the connecting rod, the other end of the connecting rod being hung into the hook portion of the hook member, the snapping protrusion being snapped with the elastic snapping assembly;

when the other end of the connecting rod is hung into the hook portion of the hook member, and the snapping protrusion is snapped with the elastic snapping assembly, the display mounting support is in a locked state; and when the snapping protrusion is separated from the elastic snapping assembly, or the other end of the connecting rod is separated from the hook portion of the hook member, the display mounting support is in an unlocked state.

2. The display mounting support according to claim 1, wherein the elastic snapping assembly comprises a grab formed at one end; the grab comprises a plane, a first inclined surface, and a second inclined surface; the first inclined surface is connected between the plane and the second inclined surface; the first inclined surface and the second inclined surface cooperatively form a V-shaped structure;

when the snapping protrusion is snapped with the elastic snapping assembly, the snapping protrusion locates at a position corresponding to a position of the plane;

during a process of the snapping protrusion to snap with the elastic snapping assembly, the snapping protrusion is resisted the second inclined surface; and during a process of the snapping protrusion to separate from the elastic snapping assembly, the snapping protrusion is resisted the first inclined surface.

3. The display mounting support according to claim 1, wherein the hook member comprises a mounting portion; the mounting portion is located above the hook portion, and connected to the hook portion; a partial structure of the elastic snapping assembly is fixed to the mounting portion and is stationary relative to the hook member, and another structure of the elastic snapping assembly is capable of stretching out and drawing back relative to the mounting portion along the height direction of the display mounting support; the snapping protrusion is located above the connecting portion; the snapping protrusion locates at a position corresponding to a position of the elastic snapping assembly; and the connecting portion locates at a position corresponding to a position of the hook portion.

4. The display mounting support according to claim 3, wherein the mounting portion comprises a first back plate segment and two adjustment segment sidewalls; the two adjustment segment sidewalls are connected two opposite sides of the first back plate segment; each adjustment segment sidewall defines an adjust hole; the elastic snapping assembly comprises a fixed member, a sliding block and an elastic member; the fixed member is fixed to the first back plate segment; the fixed member defines a hollow space on one side facing the first back plate segment; the sliding block is received in the hollow space of the fixed member; one end of the clastic member is resisted the fixed member, and the other end of the elastic member is resisted the sliding block; the hanging support further comprises an adjusting member; the adjusting member is screwed into the adjust hole, and is resisted a sidewall of the sliding block; and rotating the adjusting member is capable of adjusting a friction force between the adjusting member and the sliding block.

5. The display mounting support according to claim 4, wherein the fixed member comprises two supporting portions and a cross-connecting portion; the two supporting portions are connected to the first back plate segment through connecting members respectively; two opposite sides of the cross-connecting portion are connected to the two supporting portions respectively to form the hollow space; the fixed member comprises a resisting portion located at a side of the cross-connecting portion close to the hook member; the sliding block comprises a sliding body and a grab connected to one end of the sliding body; the sliding body is received in the hollow space; the sliding body defines a receiving hole; and when the sliding body is received in the hollow space, the resisting portion extends into the receiving hole, the elastic member is also received in the receiving hole, such that one end of the elastic member is resisted the resisting portion, and the other end of the elastic member is resisted one side of the receiving hole away from the resisting portion.

6. The display mounting support according to claim 5, wherein the hook portion comprises a second back plate segment, a hook, and two avoidance segment sidewalls; the hook is connected to the second back plate segment in the height direction of the display mounting support; the two avoidance segment sidewalls are connected to the two opposite sides of the second back plate segment, and are further connected to the two adjustment segment sidewalls, respectively, and further adjacent to the hook; and a length of the adjustment segment sidewall in a front-back direction of the display mounting support is greater than that of the avoidance segment sidewall.

7. The display mounting support according to claim 6, wherein the hanging support further comprises a snapping piece; the snapping piece is mounted on the second back plate segment; and when the connecting rod is hung into the hook portion, the connecting rod is snapped with the snapping piece.

8. The display mounting support according to claim 7, wherein the snapping piece comprises a fixed portion and a snapping portion; the fixed portion is connected to the second back plate segment; the snapping portion is bent and re-bent from the fixed portion to form a V-shaped structure; the snapping portion is located within the hook; a width of a channel formed between the snapping portion and the hook is less than an outer diameter of a rod body of the connecting rod, and passage of the connecting rod through the channel requires an elastic deformation of the snapping portion squeezed by the connecting rod to widen the channel in order for the connecting rod to pass through the channel.

9. The display mounting support according to claim 3, wherein the hook member further comprises a first connecting portion; the first connecting portion is connected to one end of the mounting portion away from the hook portion; the wall plate further comprises a plate portion and a second connecting portion; the plate portion and the second connecting portion are arranged in the height direction of the display mounting support; the plate portion is configured to mount the wall plate to the load-bearing body; the second connecting portion is spaced apart at a predetermined distance relative to the load-bearing body; the first connecting portion is inserted into one side of the second connecting portion close to the load-bearing body; and the first connecting portion and the second connecting portion are connected by screw fixed members.

10. The display mounting support according to claim 9, wherein the first connecting portion comprises a third back plate segment and two connecting segment sidewalls; the two connecting segment sidewalls are connected two opposite sides of the adjustment segment; a bayonet is defined between the connecting segment sidewall and the adjustment segment sidewall; a bottom end of the second connecting portion comprises a folding edge; and when the first connecting portion is inserted into one side of the second connecting portion close to the load-bearing body, the folding edge is snapped with the bayonet.

11. The display mounting support according to claim 10, wherein the hook member further comprises a nut column; the nut column is connected to the third back plate segment; the nut column is resisted a back surface of the second connecting portion; the second connecting portion defines a plurality of connect holes; and a screw fixed member penetrates through one of the plurality of connect holes of the second connecting portion and is then screwed with the nut column.

12. The display mounting support according to claim 11, wherein each connect hole is further marked with a scale around it, and two of the plurality of connect holes symmetrically left and right with respect to a center of the wall plate have same marking scales.

13. The display mounting support according to claim 9, wherein the plate portion defines a plurality of strip mounting holes, the plurality of strip mounting holes are disposed at an angle with respect to a vertical symmetry axis of the wall plate, and the plurality of strip mounting holes are disposed symmetrically with respect to the vertical symmetry axis of the wall plate.

14. The display mounting support according to claim 13, wherein a length of a line connecting a top of one strip mounting hole of a pair of symmetrically disposed strip mounting holes with a bottom of another strip mounting hole of the pair of symmetrically disposed strip mounting holes is equal to a length of a line connecting the center of the pair of symmetrically disposed strip mounting holes; and/or, the strip mounting hole is either a straight hole or an arcuate hole centered on a center hole of the wall plate.

15. The display mounting support according to claim 1, wherein the connecting portion comprises a first resisting member and a second resisting member; the first resisting member is connected to the back surface of the hanging member; the second resisting member is also connected to the back surface of the hanging member; the first resisting member is located between the second resisting member and the hanging member; the first resisting member and the second resisting member cooperatively form a hole; one end of the connecting rod connected to the hanging member is connected within the hole; there is sufficient friction force between the hole and the connecting rod to cause the connecting rod and the hanging member to maintain a certain angle under gravity; and the back surface of the hanging member refers to a surface of the hanging member that is back from the display screen.

16. The display mounting support according to claim 15, wherein the first resisting member defines a first arc-shaped portion, the second resisting member defines a second arc-shaped portion; and the first arc-shaped portion and the second arc-shaped portion cooperatively form the circular hole.

17. The display mounting support according to claim 16, wherein the connecting rod is in a form of a square ring; one side of the connecting rod is disconnected to form two inserting ends; and the two inserting ends are inserted into opposite ends of the hole respectively.

18. The display mounting support according to claim 1, wherein the wall plate further comprises a first wall plate, a second wall plate and a hinged piece; and the first wall plate is hinged to the second wall plate in a left-right direction of the display mounting support by using the hinged piece.

19. The display mounting support according to claim 18, wherein an end of the first wall plate adjacent to the second wall plate comprises a resisting surface, an end of the second wall plate adjacent to the first wall plate also comprises a resisting surface; when the first wall plate and the second wall plate are hinged by the hinged piece, the resisting surface of the first wall plate and the resisting surface of the second wall plate are resisted with each other, the first wall plate and the second wall plate have a 180-degree opening and closing angle between them; and/or, the wall plate defines a center hole, the center hole penetrates through the hinged piece, the first wall plate and the second wall plate.

20. The display mounting support according to claim 1, wherein the wall plate comprises a first wall plate, a second wall plate and a connecting member; the first wall plate is connected to the second wall plate in a left-right direction of the display mounting support by using the connecting member; and/or, the wall plate defines a center hole, the center hole penetrates through the connecting member, the first wall plate and the second wall plate.

* * * * *